US009435041B2

(12) United States Patent
Kilian et al.

(10) Patent No.: US 9,435,041 B2
(45) Date of Patent: Sep. 6, 2016

(54) METHOD AND REGENERATION APPARATUS FOR REGENERATING A PLATING COMPOSITION

(71) Applicant: Atotech Deutschland GmbH, Berlin (DE)

(72) Inventors: Arnd Kilian, Berlin (DE); Christian Nöthlich, Berlin (DE); Dieter Metzger, Berlin (DE); Sebastian Kühne, Berlin (DE)

(73) Assignee: ATOTECH DEUTSCHLAND GMBH, Berlin (DE)

( * ) Notice: Subject to any disclaimer, the term of this patent is extended or adjusted under 35 U.S.C. 154(b) by 0 days.

(21) Appl. No.: 14/985,761

(22) Filed: Dec. 31, 2015

(65) Prior Publication Data

US 2016/0153097 A1 Jun. 2, 2016

Related U.S. Application Data

(62) Division of application No. 14/405,307, filed as application No. PCT/EP2013/061214 on May 30, 2013, now Pat. No. 9,249,510.

(30) Foreign Application Priority Data

Jun. 5, 2012 (EP) ..... 12170872

(51) Int. Cl.
*C25B 9/08* (2006.01)
*C23C 18/54* (2006.01)

(52) U.S. Cl.
CPC *C25B 9/08* (2013.01); *C23C 18/54* (2013.01)

(58) Field of Classification Search
CPC ..... C23C 18/54; C25B 9/08
See application file for complete search history.

(56) References Cited

U.S. PATENT DOCUMENTS 6,120,673 A 9/2000 Reiter et al.
6,338,787 B1 1/2002 Obata et al.

(Continued)

FOREIGN PATENT DOCUMENTS

DE 102009027094 A1 12/2009
JP 2010150606 7/2010

OTHER PUBLICATIONS

Majima, Masatoshi et al.; "Developemnet of Titanium Redox Electroless Plating Method"; SEI Technical Review; No. 54; Jun. 2002; 67-70.

(Continued)

*Primary Examiner* — Arun S Phasge
(74) *Attorney, Agent, or Firm* — Frank J. Bonini, Jr.; John F. A. Earley, III; Harding, Earley, Follmer & Frailey, P.C.

(57) ABSTRACT

A method and apparatus for regenerating a plating composition which is suitable for depositing at least one first metal on a substrate where the plating rate in the plating composition is very low, where the concentration of the at least one first metal in the plating composition cannot be easily set at a constant level, and where plating-out of the at least one first metal from the plating composition takes place. The method and apparatus for regenerating a plating composition is suitable for depositing at least one first metal on a substrate at a sufficiently high plating rate, while offering the opportunity to easily adjust the concentration of the at least one first metal in the plating composition at a constant level and to provide the plating composition with sufficient stability against decomposition thereof in order to safeguard the regeneration cell from plated-out first metal.

12 Claims, 10 Drawing Sheets

(56) References Cited

U.S. PATENT DOCUMENTS 7,195,702 B2 3/2007 Bokisa, Sr. et al.
9,249,510 B2 * 2/2016 Kilian ..... C23C 18/1617

OTHER PUBLICATIONS

Sone, Michinari et al.; "Electroless copper plating using Fell as a reducing agent"; Electochimica Acta 49 (2004) 233-238.

Nakao, Seiichiro et al.; "Electroless pure nickel plating process with continuous electrolytic regeneration system"; Surface and Coatings Technology 169-170 (2003) 132-134.

Yagi, Shunsuke et al.; "Electroless Nickel Plating onto Minute Patterns of Copper Using Ti(IV)/Ti(III) Redox Couple"; Journal of the Electrochemical Society; 2005; C588-C592.

* cited by examiner

Condition 1:

Condition 2:

Condition 3:

Condition 1:

Condition 2:

Condition 3:

Condition 1:

Condition 2:

Condition 3:

Condition 1:

Condition 2:

Condition 3:

METHOD AND REGENERATION APPARATUS FOR REGENERATING A PLATING COMPOSITION

BACKGROUND OF THE INVENTION

1. Field of the Invention

The present invention relates to a method for regenerating a plating composition which is suitable for depositing at least one a first metal on a substrate as well as to a regeneration apparatus for regenerating said composition which is suitable for depositing said at least one a first metal on said substrate. Such methods and apparatus are used to regenerate compositions which are suitable for the generation of a metal film such as a nickel, cobalt, or tin film on a substrate, like a plastic, ceramic, glass, and/or metallic part by electroless, i.e., autocatalytic plating of metal.

2. Brief Description of the Related Art

Metal deposition is well-known since decades and has first been used to plate metallic parts like tubings, fittings, valves, and the like. These metal deposits were formed using electrolytic deposition employing an external current source and providing the electric current to the parts and to a counter electrode being in contact with a plating composition.

To plate metal on plastics and on other electrically non-conducting substrates as well as plating metal on parts having isolated metallic regions thereon which cannot be electrically contacted individually, electroless plating was developed. In this case a plating composition is used which contains ions of the metal to be plated and a reducing agent which is capable of reducing the metal to be plated. Such electroless plating compositions have extensively been investigated and used in industry. Electroless plating compositions suitable to plate copper contain, in addition to a copper salt and complexing agents for copper ions, formaldehyde as the reducing agent. These solutions are highly alkaline. Electroless plating compositions suitable to plate nickel contain, in addition to a nickel salt and complexing agents for nickel ions, a hypophosphite salt or the acid thereof, dimethylamine borane, a borohydride, or a hydrazinium salt as the reducing agent. When a hypophosphite salt or the acid thereof is used as the reducing agent, phosphorous will be incorporated into the nickel deposit which might be as much as 12 at.-% of the deposit. When dimethylamine borane or a borohydride salt is used as the reducing agent, boron will be incorporated into the nickel deposit, which might be as much as 5 at.-% of the deposit. When a hydrazinium salt is used as the reducing agent, the nickel deposit may essentially be made of pure nickel, eventually containing a small amount of nitrogen (S. Yagi, K. Murase, S. Tsukimoto, T. Hirato, Y. Awakura: "Electroless Nickel Plating onto Minute Patterns of Copper Using Ti(IV)/Ti(III) Redox Couple", J. Electrochem. Soc., 152(9), C588-C592 (2005)).

For electroless plating of nickel which is virtually free of any impurities, a nickel plating composition containing, in addition to nickel sulfate, titanium chloride ($TiCl_3$) as a reducing agent has been proposed (M. Majima, S. Inazawa, K. Koyama, Y. Tani, S. Nakayama, S. Nakao, D.-H. Kim, K. Obata: "Development of Titanium Redox Electroless Plating Method", Sei Technical Review, 54, 67-70 (2002); S. Nakao, D.-H. Kim, K. Obata, S. Inazawa, M. Majima, K. Koyama, Y. Tani: "Electroless pure nickel plating process with continuous electrolytic regeneration system", Surface and Coatings Technology, 169-170, 132-134 (2003); S. Yagi et al., ibid.).

M. Majima et al., ibid. report that the electroless nickel plating compositions contain nickel sulfate, trivalent titanium chloride, trisodium citrate, nitrilotriacetic acid and an amino acid. The pH of the composition is 8-9 and is adjusted using ammonium hydroxide. Bath temperature is 50° C. The deposition rate is reported to be in a range of from about 0.1 to about 0.2 μm/h. The experiments to show feasibility of nickel deposition were performed using a urethane foam. This resulted in a porous nickel (Celmet) that can be used as a current collector for batteries. The urethane foam was pretreated prior to electroless nickel deposition by contacting the foam with Pd which was absorbed as a catalyst by the sensitizer-activator process.

S. Yagi et al., ibid. report performing nickel deposition on minute patterns on silicon semiconductor devices which have lines and spaces which are as small as 160 nm. The plating composition is similar to that of M. Majima et al.

S. Nakao et al., ibid. additionally report that the deposition rate decreased with increasing the plating time when the concentration of trivalent titanium ions is not controlled. Such decrease would be attributed to a trivalent titanium ion concentration decrease with time because of, in addition to consumption due to the nickel deposition, spontaneous oxidation with dissolved oxygen in the solution. In order to keep the deposition rate constant by keeping the concentration of trivalent titanium ions constant, the deposition solution was subjected to electrolytic regeneration. An apparatus for such regeneration was shown to comprise the plating bath as a catholyte and a sodium sulfate solution as an anolyte and a liquid connection therebetween comprising an ion-exchange membrane.

U.S. Pat. No. 6,338,787 B1 further mentions that tin, cobalt, and lead could also be deposited and that, apart from trivalent titanium, also cobalt, tin, vanadium, iron, and chromium could be used as the reducing agents. This document specifies the ion-exchange membrane of a preparation tank to be an anion exchange membrane. Furthermore, U.S. Pat. No. 6,338,787 B1 reports that an activation process is used to prepare the plating bath which comprises using an electrode as an anode which may be made from the same metal as that of the metal which is deposited. Since the metal ions can be supplied to the plating bath by an anode dissolving reaction in the anode chamber simultaneous with activation of the plating bath by a cathode reaction in the cathode chamber, the composition of the bath can be easily regenerated. A first apparatus is shown which comprises the cathode and anode, wherein the cathode is made from platinum-coated titanium and the anode is made from nickel. In order to suppress nickel deposition on the cathode, its area is kept low so that the electrical current density at the cathode is set greater than the limit electrical current density of nickel electrodeposition. U.S. Pat. No. 6,338,787 B1 also reports using a carbon electrode which is activated with an oxidative process thus more securely preventing deposition of the deposition metal on this electrode during the activation step. A second apparatus is also shown which comprises a cathode chamber with a cathode and an anode chamber with an anode, these two chambers being separated from each other by an anion exchange membrane. The cathode chamber is connected to a plating tank and the anode chamber is connected to an anode liquid tank. The anode liquid is dilute sulfuric acid. In this case, both cathode and anode are made from carbon felt. If a nickel foil was used as the cathode instead, much less efficiency was achieved. Further, U.S. Pat. No. 6,338,787 B1 reports that nickel being deposited on the cathode can be dissolved into the plating bath if this electrode is used as an anode in the next process of activation of the bath.

It has turned out that the plating rate of the plating bath of U.S. Pat. No. 6,338,787 B1 is very low. For example 0.6 μm of nickel are deposited on a Pd-activated ABS resin plate within 2 hours. Such plating rate is too low for most industrial purposes such as manufacture of printed circuit boards, IC substrates, and the like. Furthermore, it also turned out that metal concentration in the plating bath steadily increases due to the use of an anode which is made from the metal to be deposited. Therefore, steady-state conditions cannot be achieved easily. Furthermore, it also turned out that plating out of the metal to be deposited in the regeneration cell occurs easily, if the plating bath is tuned to fast plating. This behavior is detrimental because the ion selective membrane separating the anode and cathode compartments can easily be destroyed.

SUMMARY OF THE INVENTION

It is therefore an object of the present invention to provide a method and apparatus for regenerating a plating composition which is suitable for depositing at least one first metal on a substrate without incurring the above problems, namely that the plating rate in the plating composition is very low, that the concentration of the at least one first metal in said plating composition cannot be easily set at a constant level, and that plating-out of the at least one first metal from said plating composition takes place. Therefore, it will be an object of the invention to provide a method and apparatus for regenerating said plating composition which is suitable for depositing at least one first metal on a substrate at a sufficiently high plating rate, while offering the opportunity to easily adjust the concentration of the at least one first metal in the plating composition at a constant level and to provide the plating composition with sufficient stability against decomposition thereof in order to safeguard the regeneration cell from plated-out first metal.

It is a further object of the present invention to provide a method and apparatus for continuously depositing said at least one a first metal on said substrate, involving the regeneration method and regeneration apparatus as being set herein before.

The aforementioned objects and further objects are achieved by a method for regenerating a plating composition which is suitable for depositing at least one first metal on a substrate and by an apparatus for regenerating said plating composition which is suitable for depositing said at least one first metal on said substrate.

In this method for regenerating said plating composition of the invention, the plating composition is accommodated by at least one plating device. It contains said at least one first metal in an ionic form and at least one second metal in an ionic form, wherein said at least one second metal may be provided in a higher and in a lower oxidation state and, when it is provided in a lower oxidation state, it is capable of reducing said at least one first metal being in the ionic form to a metallic state. Said method comprises the following method steps:

(a) A regeneration device is provided. This device has a working electrode and a counter electrode. Said working electrode is disposed in a working electrode compartment and said counter electrode is disposed in a counter electrode compartment. Said working electrode compartment and said counter electrode compartment are separated from each other by an ion selective membrane. Said counter electrode compartment accommodates a counter electrode liquid.

(b) At least part of said plating composition is removed from said at least one plating device.

(c) At least a fraction of said removed composition is contacted with said working electrode of said regeneration device. During the contact of said fraction of said removed composition or of said removed composition with said working electrode, said working electrode is polarized cathodically, so that said at least one second metal being provided in the higher oxidation state is reduced to the lower oxidation state and said at least one first metal is deposited on the working electrode in the metallic state. Due to this contacting and electrolyzing treatment a first portion of said removed composition is obtained.

(d) Said first portion is then removed from said removed composition and then a remainder of said removed composition (without the first portion) is contacted with said working electrode having said at least one first metal having been deposited thereon in method step (c) in the metallic state. During said contact of said remainder of said removed composition said working electrode is polarized anodically, so that said at least one first metal being deposited on said working electrode in the metallic state is dissolved into said remainder of said removed composition to form said at least one first metal in the ionic form. Due to this contacting and electrolyzing treatment of the remainder of the removed composition a second portion of said removed composition is obtained.

(e) Thereafter, said first and second portions are returned to said at least one plating device to result in said plating composition containing said at least one first metal in the ionic form and said at least one second metal being provided in the lower oxidation state, so that said plating composition is capable of reducing said at least one first metal being in the ionic form to the metallic state. The first and second portions are preferably returned to said at least one plating device separately, i.e., without letting them to come into contact with each other prior to their entrance into said at least one plating device.

The above regeneration apparatus for regenerating said plating composition according to the invention is especially adapted to perform the regeneration method of the invention. Said regeneration apparatus comprises:

(a) at least one regeneration device, each one comprising:
  i. a working electrode compartment and a counter electrode compartment;
  ii. a working electrode being disposed in said working electrode compartment and a counter electrode being disposed in said counter electrode compartment;
  iii. an ion selective membrane separating said working electrode compartment and said counter electrode compartment from each other;
  iv. an electric current supply for energizing said working electrode and said counter electrode;

(b) means for removing at least part of said plating composition from said at least one plating device and means for contacting said removed plating composition with said working electrode;

(c) at least one first holding tank being adapted for accommodating a first portion of said removed composition after said first portion of said removed composition has been cathodically treated by said regeneration device;

(d) at least one second holding tank being adapted for accommodating a second portion of said removed composition after said second portion of said removed composition has been anodically treated by said regeneration device; and (e) means for returning said first and second portions to said at least one plating device; said means for returning are preferably designed to separately return said first and second portions to said at least one plating device.

Furthermore, said at least one first holding tank and said at least one second holding tank are in fluid connection with said at least one regeneration device.

The aforementioned objects and further objects are further achieved by a method of continuously depositing said at least one first metal on said substrate and by an apparatus for continuously depositing said at least one first metal on said substrate.

This further method of continuously depositing said at least one first metal on said substrate of the invention comprises the following method steps:

(a) Said plating composition is provided to be accommodated by said at least one plating device. Said composition contains said at least one first metal in an ionic form and said at least one second metal in an ionic form. Said at least one second metal may be provided in a higher and in a lower oxidation state and, when it is provided in a lower oxidation state, is capable of reducing said at least one first metal being in the ionic form to a metallic state.

(b) Said at least one second metal being in the lower oxidation state is reacted with said at least one first metal in the ionic form, so that said at least one first metal is deposited on said substrate in the metallic state and said at least one second metal is oxidized to the higher oxidation state.

(c) A regeneration device having a working electrode and a counter electrode is provided. Said working electrode is disposed in a working electrode compartment and said counter electrode is disposed in a counter electrode compartment. Said working electrode compartment and said counter electrode compartment are separated from each other by an ion selective membrane. Said counter electrode compartment accommodates a counter electrode liquid.

(d) At least part of said plating composition is removed from said at least one plating device after said at least one first metal has been deposited on said substrate.

(e) At least a fraction of said removed composition is contacted with said working electrode of said regeneration device. During the contact of said fraction of said removed composition or of said removed composition with said working electrode, said working electrode is polarized to be cathodic, so that said at least one second metal being provided in the higher oxidation state is reduced to the lower oxidation state and said at least one first metal is deposited on the working electrode in the metallic state. Due to this contacting and electrolyzing treatment a first portion of said removed composition is obtained.

(f) Said first portion is then removed from said removed composition and then a remainder of said removed composition is contacted with said working electrode having said at least one first metal, which has been deposited thereon in method step (e) in the metallic state. During said contact of said remainder of said removed composition said working electrode is polarized anodically, so that said at least one first metal being deposited on said working electrode in the metallic state is dissolved into said remainder of said removed composition to form said at least one first metal in the ionic form. Due to this contacting and electrolyzing treatment of the remainder of the removed composition a second portion of said removed composition is obtained.

(g) Thereafter, said first and second portions are returned to said at least one plating device, resulting in said plating composition containing said at least one first metal in the ionic form and said at least one second metal being provided in the lower oxidation state, so that said plating composition is capable of reducing said at least one first metal being in the ionic form to the metallic state. The first and second portions are preferably returned to said at least one plating device separately, i.e., without letting them to come into contact with each other prior to their entrance into said at least one plating device.

The above apparatus for continuously depositing said at least one first metal on said substrate according to the invention is especially adapted to perform the above plating method of the invention. Said apparatus comprises:

(A) said at least one plating device for accommodating said composition, which contains said at least one first metal in an ionic form and said at least one second metal in an ionic form, wherein said at least one second metal may be provided in a higher and in a lower oxidation state and, when it is provided in a lower oxidation state, is capable of reducing said at least one first metal being in the ionic form to the metallic state;

(B) a regeneration apparatus, wherein said regeneration apparatus comprises:

(a) at least one of said regeneration devices, each one comprising:

i. said working electrode compartment and said counter electrode compartment;

ii. said working electrode being disposed in said working electrode compartment and said counter electrode being disposed in said counter electrode compartment;

iii. said ion selective membrane separating said working electrode compartment and said counter electrode compartment from each other;

iv. said counter electrode liquid being accommodated by said counter electrode compartment;

v. said electric current supply for energizing said working electrode and said counter electrode;

(b) said means for removing at least part of said plating composition from said at least one plating device and means for contacting said removed plating composition with said working electrode;

(c) said at least one first holding tank being adapted for accommodating a first portion of said removed composition after said first portion of said removed composition has been cathodically treated by said regeneration device;

(d) said at least one second holding tank being adapted for accommodating a second portion of said removed composition after said second portion of said removed composition has been anodically treated by said regeneration device; and (e) said means for returning said first and second portions to said at least one plating device.

These methods and apparatus of the invention are designed to overcome the deficiencies of the prior art methods and apparatus:

From the above it is clear that the at least one first metal is first deposited on the working electrode of the at least one regeneration device while this working electrode is polarized cathodically. During this (first) process step the at least one second metal in the higher oxidation state is also converted to the lower oxidation state. As the at least one first metal is accordingly depleted from the plating composition it will be replenished to it thereafter by reversing the polarity of the working electrode. During this (second) recovery step, the at least one second metal in the lower oxidation state as far as it is still contained in the plating composition will be further depleted due to the oxidation action of the anodic working electrode. Hence, contrary to the methods described in U.S. Pat. No. 6,338,787 B1, the present invention provides using a first portion of the plating composition to be treated cathodically at the working electrode and a second portion of the plating composition to be treated anodically at this same working electrode. Therefore, the at least one first metal which has been deposited on the working electrode in process step (c) of the regeneration method to give the first portion will be recovered to the plating composition in the subsequent process step (d) of this method, as the remainder of the removed plating composition is electrolyzed at the working electrode being polarized as an anode to give the second portion. These two portions of the plating composition are then returned to the at least one plating device to form the plating composition which will be capable of plating the at least one first metal on the substrate. As, due to these two process steps, the at least one first metal is depleted in the first portion of the plating composition and the at least one second metal in the lower oxidation state is enriched in this first portion, and the at least one second metal in the lower oxidation state is depleted in the second portion of the plating composition and the at least one first metal is enriched in this second portion, none of these two portions will be in danger of having the at least one first metal been plated out. Therefore, the method of the invention offers considerable stability against decomposition of the process. This is due to the fact that none of the two portions is close to, but instead far from, the working conditions of the plating composition. Furthermore, there is no need to make any efforts to suppress deposition of the at least one first metal on the working electrode as U.S. Pat. No. 6,338,787 B1 does. In fact, it was found out, that oxidation of the at least one second metal in the lower oxidation state during the treatment of the remainder of the removed composition, when the working electrode acts as an anode, is not very pronounced.

U.S. Pat. No. 6,338,787 B1 simply reports that supplying the deposition metal ions to the plating bath may be achieved by using the electrode as an anode in the next step of activation. Thus, the deposition metal (second metal in U.S. Pat. No. 6,338,787 B1) which has been coated onto the electrode in this prior art method will not be instantaneously recovered into the plating bath but at a later point of time, thereby leaving the process out of control. Furthermore, U.S. Pat. No. 6,338,787 B1 reports that the deposition metal may also be dissolved into the plating bath by using an anode which is made from that same deposition metal. This measure however, further makes the process very instable because during the activation process of U.S. Pat. No. 6,338,787 B1, apart from reducing the reducing metal (first metal in U.S. Pat. No. 6,338,787 B1) at the cathodic electrode, anodic dissolution of deposition metal at the anodic electrode will add further deposition metal ions to the plating bath in an uncontrolled manner. In addition, U.S. Pat. No. 6,338,787 B1 reports that suppression of metal deposition in the cathodic reaction in the activation step is performed preferably by adjusting the electrical current density at the cathode above the limit electrical current density or by using an oxidatively activated carbon electrode. This further practice will lead to a situation in the activation apparatus where the concentration level of the reducing metal ions is very high and where, due to the fact that only little deposition metal is deposited on the cathode, the concentration of the deposition metal ions is also high. Under these conditions, spontaneous decomposition of the plating bath may occur in the activation apparatus thereby destroying it.

For the above reasons the plating bath of U.S. Pat. No. 6,338,787 B1 will have to be composed of the components at a relatively low concentration in order to avoid spontaneous decomposition. This in turn will inevitably lead to low plating rate, thus being uneconomical.

The present invention, by contrast allows the concentrations of the at least one first and at least one second metals to be adjusted at relatively high levels so that a high plating rate is achieved. This is due to the fact that splitting the composition contained in the regeneration device into two separate portions allows for a significant better stability of the process against decomposition. This is achieved by separating the composition in a first portion which is rich in the at least one second metal in the lower oxidation state and a second portion which is rich in the at least one first metal in the ionic form. In addition, the first portion is low in the at least one first metal and the second portion is low in the at least one second metal in the lower oxidation state. Therefore, in the regeneration device a condition during which the regeneration device contains a liquid which would be close to operation (deposition) conditions will never be set. Only after combining the first and second portions, such condition (comprising providing high contents of the at least one first and second metals) is again achieved. This condition is achieved outside of the regeneration device, i.e., inside the at least one plating device.

In a preferred embodiment of the present invention, the first and second portions of the plating composition are mixed at an appropriate ratio. This will yield a regenerated plating composition having good stability against decomposition thereof and giving a constant and high plating rate. This ratio (volume of first portion to volume of second portion) may be 1.0 (50% of the first portion and 50% of the second portion) or greater or smaller than 1.0, for example up to 80% of the first portion and as low as 20% of the second portion or up to 80% of the second portion and as low as 20% of the first portion.

In a further preferred embodiment of the present invention cathodic and subsequent anodic treatment of the removed composition at the working electrode may be performed in a first method variation by treating the entire amount of the removed plating composition in the first electrolyzing method step, remove part thereof to give the first portion, and thereafter treating the remainder in the second electrolyzing method step, i.e., part of which has previously cathodically been treated, to give the second portion. In a second method variation of this embodiment treatment of the removed composition at the working electrode may be performed by treating only part of the removed composition in the first electrolyzing method step to give the first portion and thereafter, in the second electrolyzing method step, treating a second part of the removed composition which is different from the first part to give the second portion. There may be of course further variations by varying the respective amounts of removed composition be treated in the first and second electrolyzing method steps.

In a further preferred embodiment of the present invention the plating composition may, in a first method variation be removed from the at least one plating device by removing a definite volume thereof in one batch and by treating this volume in accordance with the regeneration method as described herein before. In an alternative method variation of this embodiment, the plating composition may be removed from the at least one plating device by removing two batches at the same time or subsequently and treating these two batches to yield the first portion and the second portion, respectively, or, alternatively, combining these two batches and treating the combined two batches in accordance with the regeneration method described herein before.

In a further preferred embodiment of the present invention the volume of the removed composition equals the volume of the first and second portions being returned to the at least one plating device. This makes easier control of the process possible, because if temperature of the plating composition during the plating method is higher than room temperature evaporation of the solvent of the plating composition becomes important so that evaporated solvent will have to be replenished to the at least one plating device. The amount of evaporated solvent may easily be determined by controlling the volumes of added and removed batches to the plating composition.

Removal of plating composition from the at least one plating device may for example be linked to the return of the first and second portions. For this purpose two pumps may be provided, wherein one first pump delivers the first portion which has been regenerated back to the at least one plating device and concurrently and at a constant and predetermined ratio to this return volume also removes plating composition from the at least one plating device to be fed to the regeneration apparatus and wherein one second pump delivers the second portion which has been regenerated back to the at least one plating device and concurrently and at a constant and predetermined ratio to this return volume also removes plating composition from the at least one plating device to be fed to the regeneration apparatus. This ratio (volume of first portion to volume of second portion) may preferably be set to 1.0, so that during the removal and return of plating composition no volume change will occur in the at least one plating device.

In a further preferred embodiment of the present invention, the pH of the plating composition is basically maintained, i.e., not additionally adjusted to a pH different from the pH suitable for plating operation, while said plating composition is removed from said at least one plating device or transferred to or contacted with said working electrode. More specifically, adding acidic or basic (alkaline) substances to the removed plating composition prior to treating it in the regeneration device in order to shift the pH to another value than appropriate for plating operation has been found to be disadvantageous because this would lead to an enrichment of the respective acidic or alkaline substances. Even if no additions of acidic or alkaline substances are made during the process operations before regeneration, the regeneration setup of the present invention comprising an ion selective membrane necessitates ion diffusion through the membrane as means of charge transport in the regeneration device. This in turn leads to enrichment or depletion of ions in the respective compartments of the regeneration cell. This might cause a change in pH of the plating composition being treated and this in turn will have to be compensated by adding acidic or alkaline substances in order to bring the pH back to the value suitable for electroless plating operation. Considering that the plating composition may be used for some 2 to 2.5 hours, a 24 hours long plating operation would already require 10 to 12 regeneration cycles. Each addition of chemicals/substances for pH adjustment will therefore increase the concentration of these substances in the plating composition thereby rendering plating conditions more and more unfavorable. Therefore, minimizing the accumulation of further substances in the plating composition is of importance.

In a further preferred embodiment of the present invention, a precursor composition is first formed when the plating composition is set up. For this purpose the plating method further comprises the following method steps:

Providing said precursor composition, which contains said at least one first metal and said at least one second metal in the higher and lower oxidation states at concentrations such that deposition of said at least one first metal does not take place on said substrate; said precursor composition more preferably does not contain any second metal in the lower oxidation state, e.g., trivalent titanium;

contacting at least a fraction of said precursor composition with said working electrode and polarizing said working electrode cathodically, so that said at least one second metal being provided in the higher oxidation state is reduced to the lower oxidation state and said at least one first metal is deposited on said working electrode in the metallic state, thereby yielding a first portion of said precursor composition;

after having removed said first portion of said precursor composition, contacting a remainder thereof with said working electrode having said at least one first metal having been deposited thereon in the preceding method step in the metallic state and polarizing said working electrode anodically, so that said at least one first metal being deposited on said working electrode in the metallic state is dissolved into said remainder of said precursor composition to form said at least one first metal in the ionic form, thereby yielding a second portion of said removed composition; thereafter transferring said first and second portions to said at least one plating device to result in said plating composition containing said at least one first metal in the ionic form and said at least one second metal being provided in the lower oxidation state, so that said plating composition is capable of reducing said at least one first metal being in the ionic form to the metallic state.

This method offers the advantage that the precursor solution may be produced, handled, and stored easily without the problem of oxidizing the at least one second metal from the lower oxidation state to the higher oxidation state.

More specifically, this latter process sequence is used while using tin as said at least one first metal, wherein divalent tin is used as said at least one first metal in the ionic form. Furthermore, titanium may be used as said at least one second metal, wherein trivalent titanium is said at least one second metal in the lower oxidation state and tetravalent titanium is said at least one second metal in the higher oxidation state.

For example, a precursor composition containing tetravalent titanium and no trivalent titanium is much more stable than a respective precursor composition containing trivalent titanium and/or divalent tin. The same holds true if any other first and second metals than tin and titanium, respectively, are used in a lower oxidation state which are prone to oxidation by air. Further, a composition containing solely tetravalent titanium, such as a Ti(IV) complex and optionally some additives would be environmentally benign because of the low toxicity of tetravalent titanium.

In a further preferred embodiment of the invention, the plating method further comprises providing first a precursor composition, which contains the at least one second metal in the ionic form, for example in the higher oxidation state, and no first metal, and further contacting said working electrode having said at least one first metal being deposited thereon in the metallic state with said precursor composition and polarizing said working electrode anodically, so that said at least one first metal being deposited on said working electrode in the metallic state is dissolved into said precursor composition to yield said composition, which contains said at least one first metal in the ionic form and said at least one second metal being provided in the lower oxidation state, so that said composition is capable of reducing said at least one first metal being in the ionic form to the metallic state. More preferably, if the working electrode is made of the at least one first metal, this preferred method variation may advantageously be used to replenish the at least one first metal into the precursor composition. This latter preferred embodiment offers the possibility to dissolve as much of the at least one first metal into the precursor composition as required, because the amount of the at least one first metal is not limited in such case.

More specifically, the precursor composition may contain in this preferred embodiment tetravalent titanium and no trivalent titanium and no divalent tin, or it may contain tetravalent and trivalent titanium and no divalent tin. Tin will in these cases be dissolved from the working electrode into a (second) portion of the precursor composition by polarizing the working electrode anodically. In accordance with the invention, this (second) portion will then be combined with another (first) portion of the precursor composition after this has been treated cathodically at the working electrode. A precursor composition containing tetravalent titanium and no trivalent titanium and no divalent tin is much more stable than a composition containing any one of the latter species. This is because not only trivalent titanium, but also divalent tin are easily oxidized when being stored or transported due to air oxidation. The same holds true if any other first and second metals, which are prone to oxidation by air, are used in a lower oxidation state.

The present invention comprises using only part of the precursor composition in the first regeneration step and the remainder of the precursor composition in the second regeneration step to form first and second portions of the thus formed plating composition and using these two portions as a new and regenerated plating composition. This procedure will lead to a satisfactory result as to plating rate, constancy of metal content, and, most important, stability of the plating composition against decomposition.

If, contrary to the present invention, the entire precursor composition would be electrolyzed first cathodically at the working electrode and then this electrolyzed composition would be electrolyzed anodically at this same working electrode, instability in the resulting composition would be found leading to undesirable tin deposition on the walls of the vessels being used and/or to forming tin particles in the bath volume. In this case, depending on the conditions, 80% to 100% of divalent tin contained in the precursor composition were deposited from the precursor composition in the first regeneration step on the working electrode being polarized cathodically. In this case, after cathodically contacting the working electrode with the composition and upon reversal of the polarity of the working electrode the tin deposited on the working electrode would be re-dissolved into the composition, while, depending on the conditions, only a small enough fraction of trivalent titanium would be re-oxidized in this second regeneration step. Accordingly, a composition would be obtained having a very high plating rate, which would be highly unstable. A relatively high concentration of trivalent titanium in the regeneration device is believed to cause this instability making the composition very active and causing formation of a tin colloid during the second regeneration step when tin is re-dissolved from the working electrode. These colloidal particles would subsequently act as seeds for further tin particle growth in the bath under operation, leading to the instability observed. Even using a filter to try to remove the tin colloid does not result in the required stability of the bath. In such case, fine particles of tin accumulated in the filter, thus supporting the notion that tin colloid formation during the regeneration step causes bath instability.

According to the invention, the plating composition may be regenerated as required, i.e., for example as soon as lower plating rate and/or instability against decomposition of the composition are detected. In an alternative mode of operation, regeneration is performed permanently, i.e., without any interrupt, or it may be performed intermittently, i.e., at intervals, after a prescribed interrupt time interval during which no regeneration takes place.

In this latter case the plating composition is accordingly regenerated to result in a first portion which is rich in trivalent titanium and a second portion which is rich in divalent tin. This allows for operating the plating composition at an operation point closer to high activity which makes high plating rate possible.

Apart from tin as the at least one first metal and titanium as the at least one second metal, other metals may be used, such as cobalt, nickel, lead, silver and the like as the at least one first metal and such as cerium, vanadium, cobalt, iron, manganese, and chromium as the at least one second metal. The respective ionic forms of the at least one first metal may then accordingly be divalent cobalt, divalent nickel, divalent lead, and monovalent silver and the respective lower/higher oxidation states of the at least one second metal may then accordingly be trivalent/tetravalent cerium, divalent/higher valent vanadium, trivalent/tetravalent cobalt, divalent/trivalent iron, divalent/higher valent manganese, and divalent/higher valent chromium.

In a further preferred embodiment of the present invention, if said at least one first metal in the ionic form is divalent tin and said at least one second metal in the lower and higher oxidation states is trivalent and tetravalent titanium, respectively, these metals may be provided in the form of their salts, optionally complexed with appropriate complexing agents, so that these salts are dissolved in the composition to form a solution. The salt may be a chloride salt, sulfate salt, nitrate salt, methanesulfonate, acetate salt or the like.

The plating composition may further contain at least one first complexing agent for the at least one first metal in the ionic form, e.g., for divalent tin. It may also contain at least one second complexing agent for the at least one second metal either in the lower oxidation state, e.g., trivalent titanium, or in the higher oxidation state, e.g., tetravalent titanium, of for both.

In a further preferred embodiment of the present invention said plating composition contains pyrophosphate ions. These ions may be added in the form of an alkali or earth alkaline metal salt or in the form of the acid thereof, the sodium and/or potassium salt for example. These ions constitute a complexing agent for the at least one first metal in the ionic form, divalent tin for example. Apart from pyrophosphate ions, other first complexing agents may likewise be used.

In a further preferred embodiment of the present invention said plating composition has a pH of at least about 6. The pH may be at most about 9. More preferably the pH may be at least about 7. It may more preferably be at most about 8.5. The pH may be adjusted by adding alkaline substances such as alkali or earth alkaline hydroxide or carbonate or by adding acidic substances such as sulfuric, chloric, acetic, methanesulfonic acid, or the like to the plating composition. Most preferably, the pH of the plating composition is adjusted by adding an alkali metal carbonate, like potassium carbonate, to said plating composition. A buffer system may be used to stabilize the pH. Such buffer system may be the pyrophosphate ions together with alkali and/or earth alkaline metal ions.

The plating composition may further contain at least one additive, like stabilizing and accelerating agents, such as thiourea, glycylglycine, thiopropionic acid, hydrochinone, resorcinol, and isopropanol. The stabilizing agents are suitable to prevent spontaneous deposition of the at least one first metal on the surfaces of vessels and the like and/or in the bulk of the plating composition, and the accelerating agents are suitable to accelerate plating rate.

The plating composition further comprises a solvent and may further comprise a supporting electrolyte in addition to the buffer, acid or alkaline substance. The solvent may preferably be water, the supporting electrolyte may preferably be any alkali or earth alkaline salt of an anion such as sulfate, chloride, bromide, carbonate, nitrate, acetate, methanesulfonate, or the like. Alternatively, the solvent and supporting electrolyte may be selected from organic compounds and may more specifically be selected from ionic liquids. Such systems are for example described in DE 10 2009 027 094 A1. These compounds comprise for example salts which are selected from aromatic cationic heterocyclic compounds having a further anion, such as imidazolium compounds having a further anion like halides, sulfates, and the like.

The regeneration devices of the regeneration apparatus each comprise:

i. a working electrode compartment and a counter electrode compartment;
ii. a working electrode being disposed in said working electrode compartment and a counter electrode being disposed in said counter electrode compartment;
iii. an ion selective membrane separating said working electrode compartment and said counter electrode compartment from each other;
iv. a counter electrode liquid being accommodated by said counter electrode compartment;
v. an electric current supply for energizing said working electrode and said counter electrode.

In a preferred embodiment of the present invention, said at least one working electrode is made from said at least one first metal in the metallic state. Contrary to using an inert electrode, like a carbon or activated titanium electrode, this offers the advantage that the at least one first metal deposited thereon, when this working electrode is contacted with the composition to be regenerated, does not flake off during the oxidation step leading to particles and/or crumbs in the liquid when it is contacted with the remainder of the composition, thereby causing uncontrolled plating out of the at least one first metal in the liquid at these particles and/or crumbs. By using the at least one first metal as the working electrode, during this oxidation step, the at least one first metal is homogeneously dissolved from the working electrode. In addition, if the methods of the invention are used, wherein the at least one first metal is a metal which forms poisonous salts, like nickel, transport and handling of compositions containing these metals in an ionic form will constitute some problem. By using a working electrode being made from this at least one first metal, no liquid to replenish the at least one first metal would be required to be handled and transported since the metal to be deposited will be provided by the working electrode. This will lead to an environmentally better process.

Furthermore, using such a working electrode has the additional advantage that the at least one first metal that has been consumed in the plating operation may be replenished to the plating composition in the regeneration operation. For this purpose it will be dissolved into the remainder of the removed composition and thus finally replenished into the plating composition. This allows for replenishment of the at least one first metal into the plating composition after depletion thereof from the plating composition.

In a preferred embodiment of the present invention, said at least one working electrode is made of pieces of said at least one first metal in the metallic state and wherein said pieces of said at least one first metal in the metallic state are contained in a container which is made from an inert material, preferably in a container which is made from an inert metal or from a plastics material, like polypropylene (PP) or polyvinylidenfluoride (PVDF). As the inert material, for preferably inert metal, a material is to be understood in this description and claims which does not react under the conditions of the regeneration method with any components of the plating composition or of parts thereof, such as with the at least one first and second metal, the solvent(s) of the composition, buffer, additives, and the like. Such inert material may be titanium. The container may be a basket. Therefore, the pieces may be contained in a basket made from titanium. Such construction makes easy replenishment of the material of the working electrode possible. The regeneration device may preferably be constructed to allow the plating composition to be regenerated circulate through the packing of the working electrode material in the container to have a contact with it as intense as possible. As this working electrode material will be consumed to replenish the plating composition, easy replenishment by re-filling the container facilitates processing.

In an alternative embodiment, the working electrode may, instead of from said at least one first metal, of course be made of an inert metal such as of activated titanium (being coated with platinum or with a mixed oxide, like iridium/titanium oxide or the like). The working electrode may in this case be in the form of an expanded metal like an expanded metal sheet.

The counter electrode is preferably made from an inert metal, such as of activated titanium. The working electrode may in this case be in the form of an expanded metal like an expanded metal sheet.

The working electrode compartment is in fluid connection with the plating device, so that the plating composition to be regenerated may be flown there through. The counter electrode compartment preferably is not in fluid connection with the plating device. It preferably contains a counter electrode liquid, which is preferably an inactive counter electrode liquid, i.e., to be understood in this description and claims as a counter electrode liquid which does not, apart from the solvent therein, contain any species which would react under the operation conditions of the regeneration device to give any other species. Therefore, this inactive counter electrode liquid may be an aqueous solution of dilute sulfuric acid or of any other electrolyte containing nothing else than a supporting electrolyte. The counter electrode liquid may be provided to the counter electrode compartment from a counter electrode liquid tank being in fluid connection with the counter electrode compartment.

The ion selective membrane may be any membrane which is capable of selectively letting one type of ions pass there through, either cations or anions, or exclusively monovalent cations, or exclusively monovalent anions.

In a preferred embodiment of the present invention said ion selective membrane is a cation selective membrane. In this latter case, if an inert acidic counter electrode liquid is contained in the counter electrode compartment and the removed plating composition is contained in the working electrode compartment, charge transfer between the two compartments may be supported by a transfer of protons from the counter electrode liquid contained in the counter electrode compartment to the working electrode compartment during the cathodic treatment of the removed plating composition and by a transfer of other cations from the remainder of the removed composition contained in the working electrode compartment to the counter electrode compartment during the anodic treatment of the second portion.

In an alternative embodiment of the invention, the regeneration device may, in addition to the working electrode compartment and the counter electrode compartment, further comprise a center electrode compartment located between the two other compartments. In this latter case the working electrode compartment may be separated from the center electrode compartment by an anion selective membrane and the counter electrode compartment may be separated from the center electrode compartment by a cation selective membrane. The counter electrode liquid may contain a supporting electrolyte having a pH of from about 4 to about 10, more preferably of from about 5 to about 11. The supporting electrolyte contained in the center electrode compartment may be the same one as is contained in the counter electrode compartment for example. In addition the center electrode compartment may contain further anions, like anions from an acid. Polarizing the working electrode to be cathodic and the counter electrode to be anodic will cause the cations of the supporting electrolyte contained in the counter electrode compartment being transferred to the center electrode compartment and anions contained in the removed composition being disposed in the working electrode compartment being also transferred to the center electrode compartment. Polarizing the working electrode to be anodic and the counter electrode to be cathodic will cause the previously transferred cations being transferred from the center electrode compartment back to the counter electrode compartment and the previously transferred anions being transferred from the center electrode compartment back to the working electrode compartment.

The regeneration device further comprises an electric current supply for energizing said working electrode and said counter electrode. This electric current supply will preferably be operated at direct current. It may also be capable of producing pulsed current if the overall net charge flown is either cathodic or anodic, depending on the purpose of the working electrode of being polarized cathodically or anodically, respectively. In one operation mode, the electric current supply may be operated at providing unipolar pulses (uniquely pulses which are either cathodic or anodic). The electric current supply is preferably capable of being switchable between providing cathodic polarization and anodic polarization to the working electrode in order to perform the cathodic or anodic polarization of the working electrode and respective counter-polarization of the counter electrode, as required.

The regeneration apparatus further comprises said means for removing at least part of said plating composition from said at least one plating device and means for contacting said removed plating composition with said working electrode while said working electrode is polarized cathodically or anodically, respectively. For this purpose the regeneration apparatus is in fluid connection with the plating device. More specifically the working electrode compartment of the regeneration device will be in fluid connection with the plating device. These means may preferably be appropriate connecting lines, preferably tubes, connecting the plating device with the working electrode compartment of the regeneration device. These means may further comprise pumps delivering the plating composition via these lines or respectively tubes from the at least one plating device to the working electrode compartment.

The regeneration apparatus further comprises said at least one first holding tank being adapted for accommodating said first portion of said composition after said composition has been cathodically treated by said regeneration device. These means preferably comprise a holding tank suitable for accommodating the first portion of the plating composition. Any tank that may hold this portion may be suitable. It is preferred that the tank is closed to the environment to exclude air from entering into the interior thereof to prevent oxygen from oxidizing any species contained therein such as trivalent titanium and divalent tin.

The regeneration apparatus further comprises said at least one second holding tank being adapted for accommodating said second portion of said composition after the remainder of said composition has anodically been treated by said regeneration device. Any tank that may hold this portion may be suitable. It is preferred that the tank is closed to the environment to exclude air from entering into the interior thereof to prevent oxygen from oxidizing any species contained therein such as trivalent titanium and divalent tin.

There are further connecting means provided to connect the holding tanks and the working electrode compartment of the regeneration device. For this purpose the first and second holding tanks are in fluid connection with the regeneration device, more specifically with the working electrode compartment thereof. These further means preferably comprise connecting lines, preferably tubes, and optionally pumps for delivering the portions of the composition and further optionally valves for directing the respective portion from the working electrode compartment to its holding tank.

There may further be a regeneration cell reservoir holding the removed plating composition and fluid connecting means between this cell reservoir and the working electrode compartment of the regeneration device to make continuous electrolyzing of the removed plating composition at the working electrode possible.

The regeneration apparatus further comprises said means for returning said first portion being held in said at least one first holding tank and for returning said second portion being held in said at least one second holding tank to said at least one plating device. For this purpose the first and second holding tanks are each in fluid connection with the at least one plating device. These means may preferably comprise connecting lines, preferably tubes, connecting the first and second holding tanks, respectively, with the plating device as well as optionally pumps for delivering the respective liquids to the plating device.

The plating apparatus comprises said regeneration apparatus of the invention and further said at least one plating device. Each one of the at least one plating device may be any conventional plating device suitable for accommodating the plating composition and for subjecting the plating composition to the conditions necessary for plating the at least one first metal on said substrate. This includes for example a container for holding the plating composition, means for delivering the plating composition to the substrate and a substrate holder. These latter items may be a suitable holder and means for contacting the substrate with the plating composition if it is in the container or in a treatment region, such as pumps and nozzles for delivering the plating composition to the substrate, or a moving mechanism which moves the substrate into the plating composition held in the container and out of it. It may furthermore contain heating, circulating, deaerating, analyzing, replenishing means for the plating composition, moving means for the substrate/substrate holder and the like. A plurality of plating devices may be assembled together to form a row or the like.

The substrate may be a plastic, ceramic, metal, or other work piece. It may be pretreated appropriately prior to being plated with the at least one first metal. If it is made from metal it will have to be cleaned, degreased, and pickled prior to plating. If it is made from an electrically nonconducting material it will have to be activated, like with a palladium/tin activator or the like, prior to plating. All these methods are well-known to a person skilled in the art.

The following examples and figures more clearly describe the present invention.

BRIEF DESCRIPTION OF THE DRAWING FIGURES

DETAILED DESCRIPTION OF THE INVENTION

Like reference signs in the figures denote elements having the same function.

Figure 1:
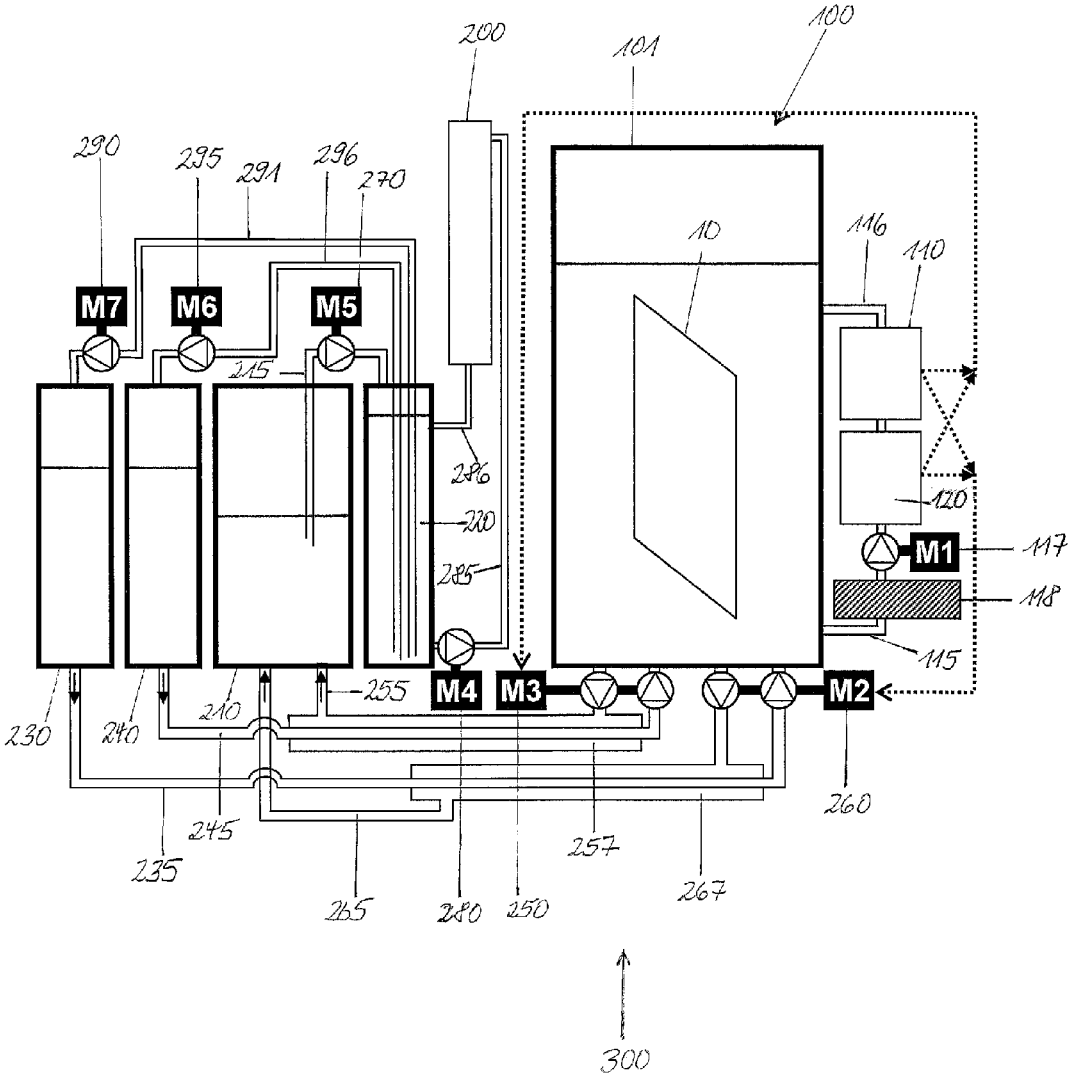
FIG. 1 shows a schematic drawing of the plating apparatus including the regeneration apparatus of the present invention.

A schematic drawing of the plating apparatus comprising the regeneration apparatus is shown in FIG. 1:

This apparatus comprises a plating device 100 comprising a tank 101, a substrate 10 held in the tank 101, an intermediate tank 210 holding the exhausted plating composition, a regeneration cell reservoir 220, a regeneration device 200, a first holding tank 230, a second holding tank 240, a first metal, e.g., Sn, measurement monitor 110, a second metal in the lower oxidation state, e.g., $Ti^{+3}$, measurement monitor 120, tubes 115, 116, 215, 235, 245, 255, 265, 285, 286, 291, 296 connecting these devices and pumps 117, 250, 260, 270, 280, 290, 295 conveying the solutions between these devices.

The plating device 100 may comprise a simple tank 101 accommodating the plating composition, a tin electroless plating composition for example. In such case, a work piece 10 may be immersed into the plating composition contained in the tank 101 by holding the work piece 10 by a work piece holder and a mechanism which moves the work piece holder up and down (not shown). The plating device 100 may moreover be equipped with a heating, an electrical heating for example, stirring means, optionally gas supply means, e.g., air or $N_2$, supply means, an external circulation which comprises respective tubes, a circulation pump and filters to remove any impurity from the composition, an exhaust device removing any gases escaping from the plating bath (not shown), as well as the sensors 110, 120 and other devices. This plating device 100 may be part of a plating line additionally comprising further treatment and/or plating devices. Alternatively, the plating device 100 may be a conveyorized device which has a container to accommodate the plating composition as well as a conveyor to convey work pieces through the plating device 100 and further delivery means like nozzles through which the plating composition is conveyed and brought into contact with the work pieces 10. Such conveying devices are well-known.

The plating device 100 has measurement monitors 110, 120 as sensors to monitor the divalent tin and trivalent titanium concentrations. These monitors 110, 120 and a sensor pump 117 are connected to the plating device 100 by lines 115, 116 in a by-pass. This by-pass further comprises a cooling device 118 which cools down the plating composition before this composition comes into contact with the sensors 110, 120. A first sensor 110 senses the overall divalent tin content using an XRF technique for example. A second sensor 120 senses the trivalent titanium content using a UV/VIS spectrometric technique. The sensors 110, 120 generate digital signals proportional to the respective concentrations of these species and feed the signals obtained to two pumps, a first feed pump 260 and a second feed pump 250.

The regeneration device 200, the intermediate tank 210 holding the plating composition, the regeneration cell reservoir 220, the first holding tank 230 and the second holding tank 240, as well as the tubes 115, 116, 215, 235, 245, 255, 265, 285, 286, 291, 296 connecting these devices and pumps 117, 250, 260, 270, 280, 290, 295 delivering the solutions between these devices collectively form a regeneration apparatus 300.

The first feed pump 260 may be a cassette tubing pump or a valveless piston-operated pump (such as the CeramPump® from Fluid Metering Inc., US). which delivers a first fraction of the exhausted plating composition from the plating device 100 via a line 255 to the intermediate tank 210 holding the exhausted plating composition. For this purpose the first feed pump 260 is connected to the plating device 100 and via line 265 to the intermediate tank 210. This first feed pump 260 additionally delivers the $Ti^{+3}$-rich first portion of the plating composition from the first holding tank 230 via a line 235 to the tank 101 of the plating device 100 and for this purpose is also connected via this line 235 with the first holding tank 230. Instead of by the first feed pump, regenerated composition may be recirculated to the plating tank 101 by the force of gravity, if a further dosing tank is installed to be arranged above the plating tank.

The second feed pump 250 is also a cassette tubing pump which delivers a second fraction of the exhausted plating composition from the plating device 100 via a line 255 to the intermediate tank 210. For this purpose the second feed pump 250 is connected to the plating device 100 and via this line 255 to the intermediate tank 210. This second feed pump 250 additionally delivers the $Sn^{+2}$-rich second portion of the regenerated plating composition from the second holding tank 240 via a line 245 to the tank 101 of the plating device 100 and for this purpose is also connected via this line 245 with the second holding tank 240.

The exhausted plating composition being delivered via lines 255, 265 is cooled in heat exchangers 257, 267 by means of the flowing back first and second portions coming from the first and second holding tanks 230, 240.

A transfer pump 270 serves to deliver the exhausted plating composition contained in the intermediate tank 210 via a line 215 to the regeneration cell reservoir 220. To this end the intermediate tank 210 is connected via this line 215 with the regeneration cell reservoir 220.

A circulation pump 280 serves to circulate the exhausted plating composition in a circuit formed by the lines 285, 286 between the regeneration cell reservoir 220 and the regeneration device 200.

A first portion pump 290 serves to deliver a first ($Ti^{+3}$-rich) portion of the plating composition coming from the regeneration cell reservoir 220 via a line 291 to the first holding tank 230. For this purpose the regeneration cell reservoir 220 is connected via this line 291 with the first holding tank 230.

A second portion pump 295 serves to deliver a second ($Sn^{+2}$-rich) portion of the plating composition from the regeneration cell reservoir 220 via line 296 to the second holding tank 240. To this end the regeneration cell reservoir 220 is connected via this line 296 with the second holding tank 240.

Figure 2:
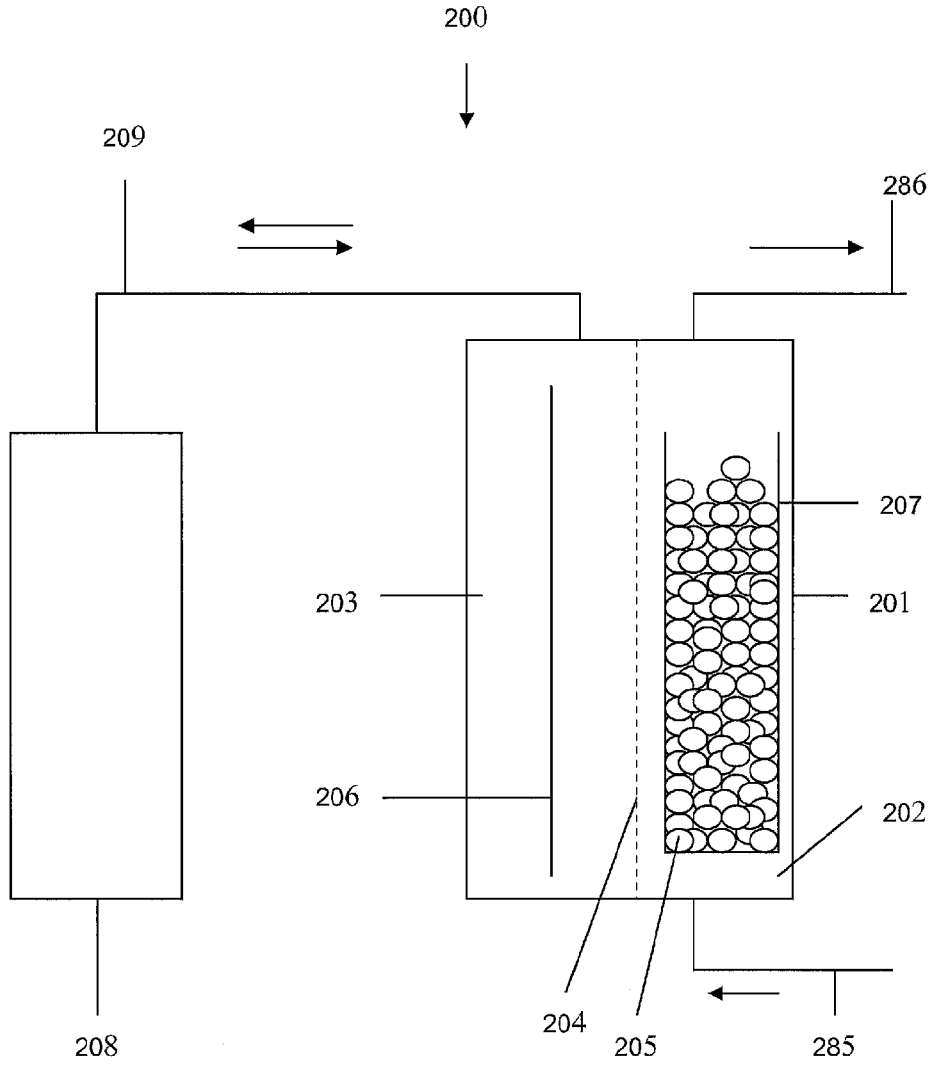
FIG. 2 shows a schematic drawing of the regeneration cell or the regeneration device.

The regeneration device 200 (without current supply) is shown schematically in FIG. 2. The regeneration device 200 comprises a regeneration cell housing 201 which may be made from plastics such as polypropylene and is fluid-tight. The regeneration cell housing 201 accommodates two electrolyte compartments, a working electrode compartment 202, which is designed to accommodate in a circulating manner the plating composition, as well as a counter electrode compartment 203. The two compartments 202, 203 are separated from each other by a cation selective membrane 204. A working electrode 205 is disposed in the working electrode compartment 202 and a counter electrode 206 is disposed in the counter electrode compartment 203. The working electrode 205 is formed by tin pieces, e.g., 0.5 cm large tin pellets which are contained in a titanium basket 207 preferably made of titanium mesh or titanium expanded metal. The basket may of course also be made of any other inert material as far as it allow liquid to flow through like perforated material. The counter electrode 206 is preferably an inert electrode. It may be formed by an expanded metal sheet made of titanium which is activated by a mixed oxide coating (iridium oxide/titanium oxide mixture). The two electrodes 205, 206 are supplied with direct electrical current by an electric current supply (not shown).

Furthermore, there is a counter electrode liquid tank 208 which is in fluid connection with the counter electrode compartment 203 via a line 209. The counter electrode compartment 203 and the counter electrode liquid tank 208 contain a counter electrode liquid which may be dilute sulfuric acid, 10 wt.-% sulfuric acid for example. A pump (not shown) delivers the counter electrode liquid to the counter electrode compartment 203. The working electrode compartment 202 is filled with the plating composition. The plating composition is delivered to this compartment 202 via line 285 and drained via line 286.

COMPARATIVE EXAMPLE

The regeneration method of the present invention is based on the fact that a composition can be formulated that contains a substantially higher overall titanium (Ti) content than the content of trivalent titanium ($Ti^{+3}$) present in the plating composition because of a very low divalent tin ($Sn^{+2}$) content. The plating composition may contain 80 mmol/l $Ti^{+3}$ and 40 mmol/l $Ti^{+4}$, for example. In this Comparison Example, the plating composition is reduced completely in the regeneration device 200 by transferring part of the plating composition to the regeneration cell reservoir 220 and then circulating the plating composition between this reservoir 220 and the working electrode compartment 202 of the regeneration device 200, wherein the working electrode 205 is polarized cathodically. Due to this cathodic treatment a $Ti^{+3}$-content of up to 120 mmol/l is achieved, at least if the current is not reversed to dissolve metallic tin from the working electrode 205 to form divalent tin ($Sn^{+2}$) as practiced according to the present invention. 120 mmol/l $Ti^{+3}$ are likely to be higher than useful for the formulation of a stable plating composition. But this composition would allow the replenishment of $Ti^{+3}$ to a plating composition having less than 120 mmol/l $Ti^{+3}$ by removing part of the plating composition (having less than 80 mmol/l $Ti^{+3}$ for example) and, after having regenerated this part of the plating composition in the regeneration device 200, replacing it with the same volume of the plating solution having 120 mmol/l $Ti^{+3}$ after regeneration. If this regeneration solution contains the proper amount of $Sn^{+2}$ for the plating operation (for example 40 mmol/l $Sn^{+2}$ due to further replenishment of $Sn^{+2}$), it will be likely that plate out occurs when this solution is heated to the plating temperature prior to being delivered to the plating device 100 because of the high $Ti^{+3}$-content. In fact, the concentration of $Ti^{+3}$ under these conditions is not as high as 120 mmol/l since current reversal at the working electrode 205 to dissolve metallic tin to produce $Sn^{+2}$ for replenishment will also partly oxidize $Ti^{+3}$ to $Ti^{+4}$. But the $Ti^{+3}$ concentration will still be significantly higher than necessary for a plating composition since otherwise the replenishment scheme would not work.

Example of the Invention

To overcome the problems of the above procedure, the regeneration is to be run according to the invention in two steps to create two different replenishment solutions (which are the first and second portions of the plating composition): During a first regeneration step, tetravalent Ti contained in the exhausted plating composition fed to the regeneration cell 200 is completely reduced to trivalent Ti, giving a solution with up to 120 mmol/l $Ti^{+3}$, but being low in $Sn^{+2}$ because Sn is deposited on the working electrode 205. After a certain amount of the plating composition (first portion) has been pumped out of the regeneration device 200, the process is continued with reversed current on the remainder of the plating composition remaining in the regeneration device 200 to give a solution which is high in $Sn^{+2}$ (e.g., 120 mmol/l), but low in $Ti^{+3}$, which is due to tin dissolution from the working electrode 205 and, to a small extent, also oxidation of $Ti^{+3}$ to $Ti^{+4}$.

The plating composition contained in the plating device 100 which is subjected to the regeneration method according to the present invention may have the following composition:

40 mmol/l $Sn^{+2}$ added as $SnCl_2$
70 mmol/l $Ti^{+3}$ added as $TiCl_3$
40 mmol/l $Ti^{+4}$ added as $TiOCl_2$
1200 mmol/l pyrophosphate ions
1000 mmol/l chloride ions
pH: 8

A part of the exhausted plating composition contained in the tank 101 is delivered by the first and second feed pumps 250, 260 from the plating device 100 to the intermediate tank 210 provided for holding the exhausted bath. During this transfer the plating bath passes first and second heat exchangers 257, 267 so that the bath being transferred is cooled down to a low temperature such as to 30° C. The plating composition is then delivered using the transfer pump 270 from the intermediate tank 210 to the regeneration cell reservoir 220 via the line 215. As this reservoir 220 is connected to the regeneration device 200, the plating composition is then continuously pumped using circulation pump 280 via lines 285, 286 through the working electrode compartment 202 of the regeneration device 200 and back to the cell reservoir 220. During this circulation the working electrode 205 is polarized cathodically against the counter electrode 206 contained in the counter electrode compartment 203 of the regeneration device 200 using the electric current supply (not shown). Due to this electrolyzing operation $Ti^{+3}$ is formed from $Ti^{+4}$. Concurrently, $Sn^{+2}$ is reduced electrolytically to deposit metallic tin on the working electrode 205. After this first regeneration cycle has been finished the concentration of $Ti^{+3}$ in the plating composition contained in the regeneration cell reservoir 220 has increased to 158 mmol/l and the concentration of $Sn^{+2}$ has decreased to 4 mmol/l.

Thereafter a fraction of this composition is delivered by the first portion pump 290 from the regeneration cell reservoir 220 via line 291 to the first holding tank 230. This first portion of the regenerated composition and being transferred to the first holding tank 230 is larger than the remainder of the composition still remaining in the regeneration cell reservoir 220. The first portion of the plating composition contained in the first holding tank 230 is accordingly a $Ti^{+3}$-rich solution which does not contain any or only very little $Sn^{+2}$.

Subsequently, the remainder of the plating composition remaining in the regeneration cell reservoir 220 is continuously pumped using the circulation pump 280 via lines 285, 286 through the working electrode compartment 202 and back to the cell reservoir 220. During this circulation the working electrode 205 is polarized anodically against the counter electrode 206 contained in the regeneration device 200 using the electric current supply (not shown). Due to this electrolyzing operation metallic tin is electrolytically dissolved from the working electrode 205 to result in a $Sn^{+2}$-rich solution. Further, part of the $Ti^{+3}$ still present in this remainder of the plating composition is oxidized to $Ti^{+4}$. After this second regeneration cycle has been finished the concentration of $Sn^{+2}$ in the thus formed second portion of the plating composition has increased to 200 mmol/l and the concentration of $Ti^{+3}$ has decreased to 46 mmol/l.

Thereafter, the second portion of the plating composition is delivered from the regeneration cell reservoir 220 by the second portion pump 295 via line 296 to the second holding tank 240. The second portion of the plating composition contained in the second holding tank 240 is accordingly a $Sn^{+2}$-rich solution which does also contain some $Ti^{+4}$ and less $Ti^{+3}$ than usually in the plating composition.

The first portion of the regenerated plating composition contained in the first holding tank 230 and the second portion of the regenerated plating composition contained in the second holding tank 240 are then delivered by the first and second feed pumps 250, 260 via lines 235, 245 to the plating device 100. During their return to the plating device 100 the first and second portions of the plating composition are heated in the heat exchangers 257, 267 to attain approximately the temperature set in the plating device 100. Heating of these two portions may be performed without being in danger of plating out tin. Vigorous mixing at the point where the solutions enter the plating device 100 prevents plating out of tin at this location. When the solutions are added to the plating composition in the plating device 100, an equal amount of plating composition is removed to keep the bath volume constant by using the cassette tubing pumps 250, 260.

After regeneration of the plating composition it has the following composition:

40 mmol/l $Sn^{+2}$ as $SnCl_2$
76 mmol/l $Ti^{+3}$ as $TiCl_3$
44 mmol/l $Ti^{+4}$ as $TiOCl_2$
1200 mmol/l pyrophosphate ions
1000 mmol/l chloride ions
pH: 8

It turns out that the plating composition contained in the plating device 100 is able to electrolessly plate tin on an activated plastic part at a plating rate of about 1.0-1.2 μm/h. During this period no noticeable amounts of tin plated out at any vessel walls of the plating device 100, the lines/tubings, pumps, and/or the regeneration device 200 or in the bulk volume of the plating composition.

The first and second feed pumps 250, 260 that exchange the plating composition contained in the plating device 100 against the respective replenishment solution (first and second portions having been regenerated) shall guarantee that the amount pumped out from the plating device 100 matches the amount pumped in, since the actual setup also needs water dosing to compensate for evaporation (or the bath might be diluted by the water dosing or overflow). Therefore, these pumps 250, 260 are coupled for that purpose (as is shown in FIG. 1), which might easiest be realized with the two cassette tubing pumps 250, 260. These pumps 250, 260 are controlled by the measurement devices 110, 120 for the content of the $Sn^{+2}$ and $Ti^{+3}$ species in the plating composition contained in the plating device 100. If the $Sn^{+2}$ content and/or $Ti^{+3}$ content have decreased under a respective predetermined value the first and second feed pumps 250, 260 initiate a regeneration cycle by pumping the exhausted plating composition out of the plating device 100 into the intermediate tank 210 holding the plating composition and from there to the regeneration cell reservoir 220 to be regenerated in the regeneration device 200.

The method as described herein above may be performed on a permanent intermittent basis by continuously removing part of the plating composition from the plating device 100 and treating this part according to the regeneration scheme described herein above. In an alternative variation, such removal of part of the plating composition from the plating device 100 may be performed by removing such part from the plating device 100 and regenerating same intermittently from time to time with idle times being in between where no regeneration of any plating composition takes place in the regeneration device 200.

The splitting of the plating composition into two replenishment solutions (first and second portions of the plating composition) has the additional advantage that the system can react more flexible towards different working conditions, e.g., an idle time during which only $Ti^{+3}$ is consumed and times with low/high surface area to be plated resulting in varying $Sn^{+2}$ consumption.

The following Tables 1 and 2 show the individual tasks and operation modes of the pumps.

TABLE 1

Detailed Schematic of Plating Tank Operation

| Pump | Task | Operation mode |
|---|---|---|
| Sensor pump 117 | Sample circulation | Continuous or intermittent |
| First feed pump 260 | $Ti^{+3}$ replenishment | Activated by UV-Vis measurement result |
| Second feed pump 250 | $Sn^{+2}$ replenishment | Activated during $Ti^{+3}$ replenishment and by $Sn^{+2}$ measurement result |

TABLE 2

Detailed Schematic of Regeneration Operation

| Pump | Task and Operation mode |
|---|---|
| Transfer pump 270 | Transfer of liquid from the intermediate tank 210 holding the exhausted plating composition to regeneration cell reservoir 220<br>Activated by computer during regeneration sequence<br>Stops by timer or level switch |
| Circulation pump 280 | Circulation<br>Continuous, stops during transfer operation of the other pumps |
| First portion pump 290 | Transfer of liquid from regeneration cell reservoir 220 to first holding tank 230 for $Ti^{+3}$ rich solution<br>Activated by computer during regeneration sequence<br>Stops by timer or level switch. |
| Second portion pump 295 | Transfer of liquid from regeneration cell reservoir 220 to second holding tank 240 for $Sn^{+2}$ rich solution<br>Activated by computer during regeneration sequence<br>Stops by timer or level switch |

The following Table 3 shows the steps of the regeneration method of the invention:

TABLE 3

Regeneration Procedure

Figure 3A:
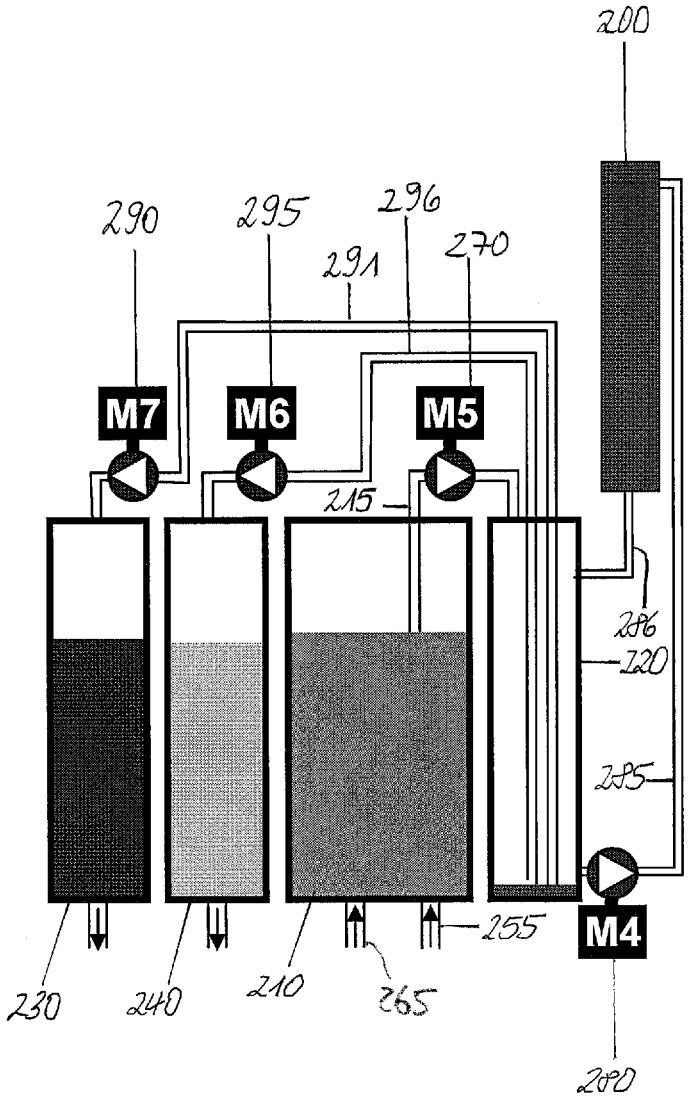
FIG. 3A shows a schematic drawing of the regeneration apparatus in a first method step involving filling of a regeneration cell reservoir from an intermediate tank holding the exhausted plating composition via lines.
Figure 3B:
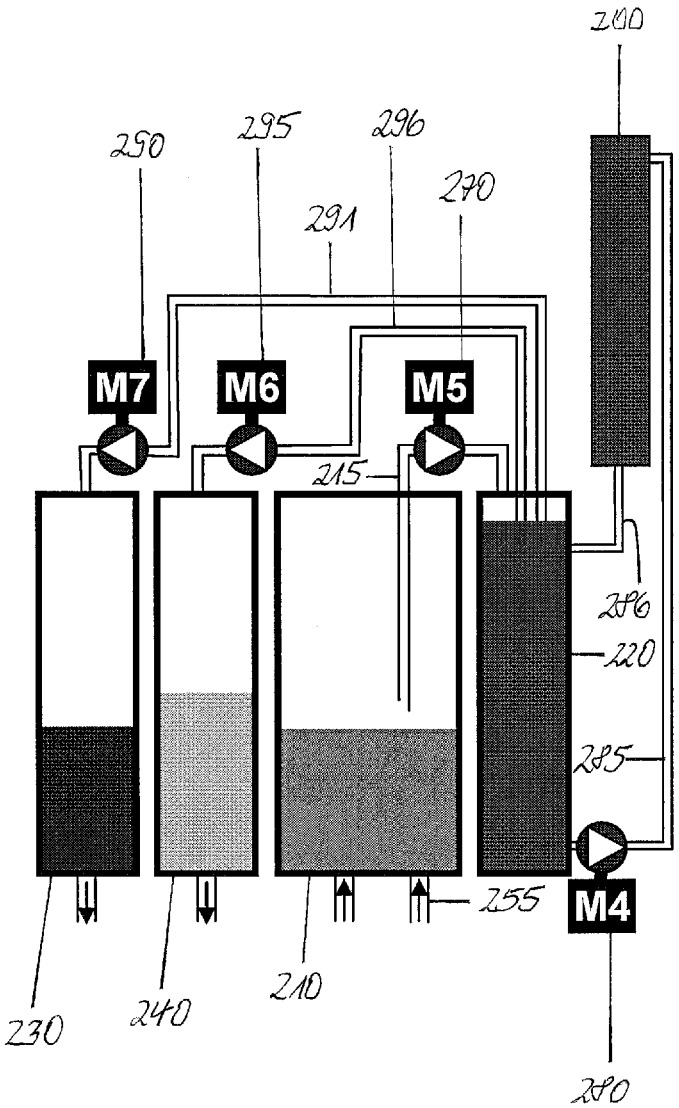
FIG. 3B shows a schematic drawing of the regeneration apparatus in a second method step involving operation of the regeneration device in the reducing (cathodic) mode.
Figure 3C:
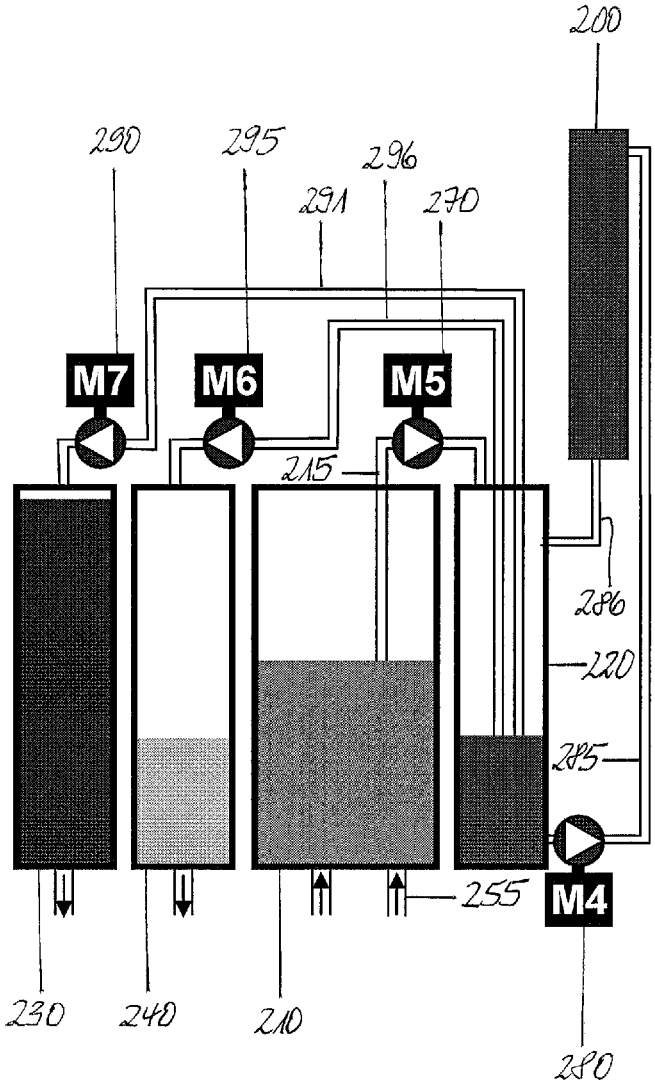
FIG. 3C shows a schematic drawing of the regeneration apparatus in a third method step involving transfer of a (larger) fraction of liquid (first portion) from the regeneration cell reservoir to the first holding tank and operation of the regeneration device in the dissolution (anodic) mode to oxidize tin and dissolve the $Sn^{+2}$ being produced.
Figure 3D:
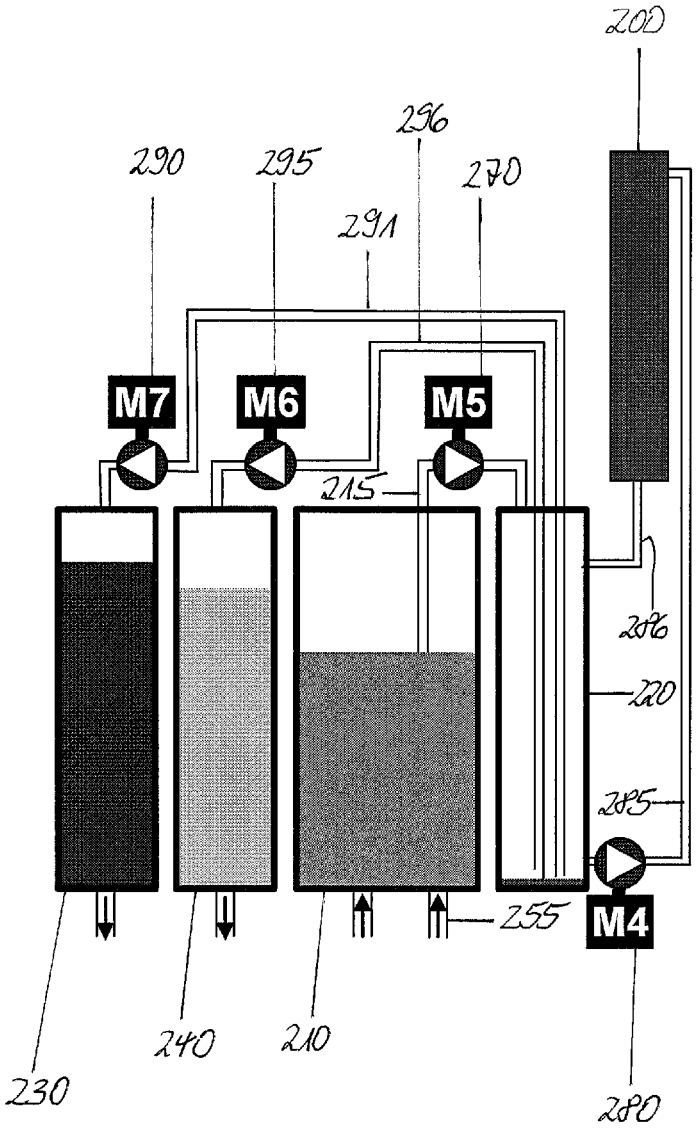
FIG. 3D shows a schematic drawing of the regeneration apparatus in a fourth method step involving transfer of the regenerated remainder of the liquid (second portion) from the regeneration cell reservoir to the second holding tank.

| | |
|---|---|
| Step 1:<br>Filling of regeneration cell reservoir 200 from the intermediate tank 210 holding the exhausted plating composition via lines 255, 265 | See FIG. 3A |
| Step 2:<br>Operation of the regeneration device 200 in the reducing (cathodic) mode to reach 120 mmol/l $Ti^{+3}$, $Sn^{+2}$ is plated out on the working electrode 205 | See FIG. 3B |
| Step 3:<br>Transfer of a (larger) fraction of the liquid (first portion) from the regeneration cell reservoir 220 to the first holding tank 230 for $Ti^{+3}$ (120 mmol/l) rich solution via line 291.<br>Operation of the regeneration device 200 in the dissolution (anodic) mode to oxidize tin and dissolve the $Sn^{+2}$ being produced into the remainder of the composition to reach 120 mmol/l $Sn^{+2}$, $Ti^{+3}$ is somewhat reduced: | See FIG. 3C |
| Step 4:<br>Transfer of the regenerated remainder of the liquid (second portion) from the regeneration cell reservoir 220 to the second holding tank 240 for $Sn^{+2}$ (120 mmol/l) rich solution via line 296.<br>Then back to Step 1. | See FIG. 3D |

Regeneration Device Layout

For an optimum lay out of the regeneration device 200 and minimization of ion enrichment during the regeneration procedure, the nature of $Ti^{+3}$ parasitic consumption is to be considered. $Ti^{+3}$ oxidation to $Ti^{+4}$ proceeds even without Sn deposition and is due to air oxidation of $Ti^{+4}$. This can lead either to $H_2$ generation or $O_2$ reduction:

Oxidation Half-Reaction:

$$Ti^{+3} \rightarrow Ti^{+4} + e^- \quad (E_{red}=0.1 \text{ V vs. } H^+/H_2 \text{ in acidic medium})$$

Reduction Half-Reaction:

$$H^+ + e^- \rightarrow \tfrac{1}{2}H_2\uparrow \quad (E_{red}=0 \text{ V vs. } H^+/H_2 \text{ in acidic medium})$$

or:

$$2H^+ + 2e^- + \tfrac{1}{2}O_2 \rightarrow H_2O \quad (E_{red}=1.23 \text{ V vs. } H^+/H_2 \text{ in acidic medium})$$

If oxygen (air) is excluded from the composition to be regenerated and the solution is degassed, only the first half-reaction will be possible. The more positive reduction potential of the second reaction will lead to an enhanced $Ti^{+3}$ consumption in the presence of oxygen. However, preliminary experiments under $N_2$ atmosphere did not show a reduced $Ti^{+3}$ consumption rate. A similar observation is reported in the literature for a Ti(III)/Ni(II) autocatalytic bath, were the plating rate was not influenced by air or $N_2$ agitation (S. Yagi et al., ibid.). Eventually light exposure plays an additional role, since it was observed that a $Ti^{+3}$ complexer solution in a sealed bottle (oxygen excluded except what was in the bottle above the liquid) reacts much faster when exposed to light than in the dark. Regardless of the reduction half reaction, one proton is consumed per electron and thus per oxidized $Ti^{+3}$ ion, resulting in a more basic solution:

$$Ti^{+3}+H^{+}\rightarrow Ti^{+4}+\tfrac{1}{2}H_2\uparrow \quad (A)$$

$$Ti^{+3}+H^{+}+\tfrac{1}{4}O_2\rightarrow Ti^{+4}+\tfrac{1}{2}H_2O \quad (B)$$

This should lead to an increase in pH during the parasitic consumption of $Ti^{+3}$, which has been observed in the solutions of the invention. As will be seen, the arrangement of the regeneration device 200 can be chosen that the necessary ion transport though the membrane 204 will be close to compensate for this pH increase. This minimizes ion enrichment.

Regeneration Schemes

The following schemes are considered:

Embodiment 1

Cation selective membrane 204, $H_2SO_4$ as the anodic liquid in the counter electrode compartment 203.

Embodiment 2

Cation selective membrane 204, $K_4P_2O_7/H_4P_2O_7$ at pH=bath pH (=7) as the anodic liquid in the counter electrode compartment 203.

Embodiment 3

Cation selective membrane 204, acidic K-salt solution as the anodic liquid in the counter electrode compartment 203.

Embodiment 4

Anion (chloride ion) selective membrane 204, anodic liquid in the counter electrode compartment 203.

Embodiment 4 requires a monovalent anion selective membrane 204. In this case charge transport during regeneration takes place by the chloride anions contained in the plating composition moving through the membrane 204 away from the plating composition contained in the working electrode compartment 202, but other monovalent anions like Sn or Ti complexes might be transported, too. This scheme requires a third (center) electrode compartment in the regeneration device 200 to prevent the chloride ions from reaching the counter electrode 206 when it is polarized anodic, where the chloride ions would form poisonous chlorine.

Three operating conditions have to be considered for the regeneration device 200: Condition 1: Open circuit (no current applied, e.g., during filling/emptying of the cell 200), Condition 2: current direction for $Ti^{+3}$ formation (cathodic polarization of the working electrode 205) and Condition 3: current direction for Sn dissolution (anodic polarization of the working electrode 205). These three operating conditions are illustrated in the following Tables 4 to 7 for the different arrangements of the regeneration device 200. It is emphasized that Condition 1: (open circuit) can be reduced to be very short in a suitable arrangement to switch to Condition 2 ($Ti^{+3}$-regeneration).

It is also important to know that the efficiency (amount of $Ti^{+3}$ formed per charge) in Condition 2 is not very high (we measured approx. 20 to 40%, depending of the applied voltage) presumably because of $H_2$ generation, which is observable by bubble formation. The same measurements have shown that the efficiency it is much better in Condition 3: Sn dissolution.

Embodiment 1

Cation Selective Membrane 204, $H_2SO_4$ as the Anodic Liquid in the Counter Electrode Compartment 203

TABLE 4

Figure 4:
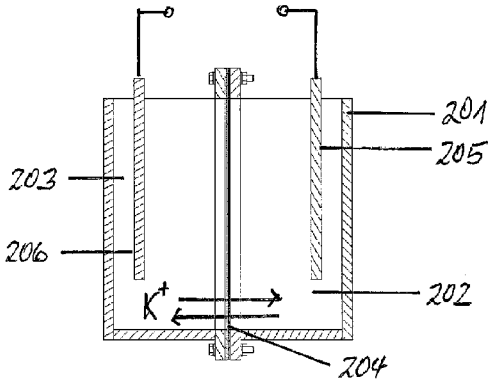
FIG. 4 shows schematic drawings of the plating device in a first plating embodiment (Case 1)
Figure 4:
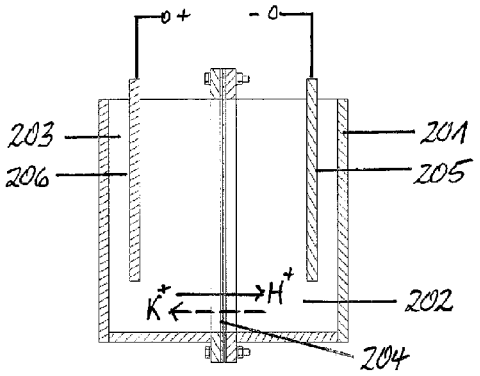
Figure 4:
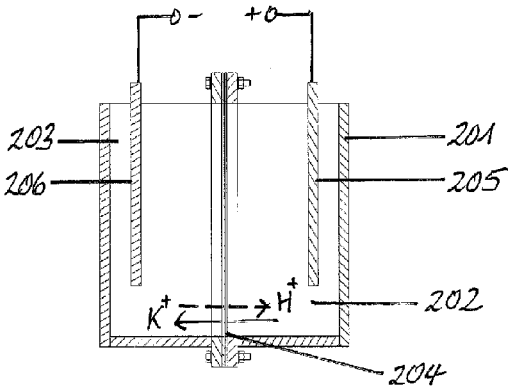

| Embodiment 1 - Cation selective membrane, $H_2SO_4$ in counter electrode compartment; see FIG. 4. | |
|---|---|
| Condition 1: Open Circuit:<br>I = 0 A, V = membrane potential<br>During idle time, pH drop is caused by the diffusion of $H^+$ from the counter electrode compartment 203 through the membrane 204 to the working electrode compartment 202, and the simultaneous diffusion of $K^+$ in the opposite direction (eventually also $Sn^{+2}/Ti^{+3}/Ti^{+4}$ or their cationic complexes). If the membrane 204 is more permeable for $H^+$ than for the other cations, a membrane potential would result in this arrangement. | To maintain pH, add $K_2CO_3$<br>Accumulation of eventually a small amount of $K^+$ ions to compensate for $H^+$ ions diffusing to the working electrode 205 |
| Condition 2: $Ti^{+3}$-Reqeneration:<br>Working electrode 205 cathodic, counter electrode 206 anodic, I ≈ 1.5 A<br>The electrical field should slow $K^+$ to diffuse to the counter electrode compartment 203. The diffusion of $H^+$ is field assisted, which should be the main contribution to the pH decrease in the working electrode compartment 202. $H^+$ movement from the counter electrode compartment 203 to the working electrode compartment 202 can be measured as the current flow. After some time in Condition 1 or 3, $K^+$ may accumulate in the counter electrode compartment 203. | To maintain pH, add $K_2CO_3$<br>Amount: 0.5 mol per mol $Ti^{+4}$ converted to $Ti^{+3}$<br>Accumulation of substantial amount of $K^+$(0.5 mol per mol $Ti^{+4}$) to compensate for $H^+$ diffusing to the working electrode compartment 202 |
| Condition 3: Sn-Dissolution:<br>Working electrode 205 anodic, counter electrode 206 | To maintain pH, add $K_2CO_3$<br>Amount: 1 mol per mol Sn being |

TABLE 4-continued

| Embodiment 1 - Cation selective membrane, $H_2SO_4$ in counter electrode compartment; see FIG. 4. | |
|---|---|
| cathodic, I ≈ 1.5 A | dissolved |
| The electrical field should accelerate the $K^+$ diffusion into the counter electrode compartment 203, while $H^+$ diffusion is hindered. This mode will lead to the quickest $K^+$ movement in the counter electrode compartment 203. Since it is not known what the different permeability values of the membrane 204 for the different cations are, it is difficult to predict which mode has the quickest pH change. | Accumulation of close to nothing since all $K_2CO_3$ is consumed by $K^+$ diffusing to the counter electrode compartment 203 |

For longer operating times of the regeneration scheme, $K^+$ may accumulate in the counter electrode compartment 203 so that over time the situation becomes more similar to Embodiment 3. In order to prevent this, the counter electrode liquid (dilute $H_2SO_4$) may be changed frequently. A more elegant method will be to circulate the counter electrode liquid through an ion exchange resin that absorbs $K^+$.

A definite advantage of Embodiment 1 is that during Condition 2 ($Ti^{+3}$-regeneration), when a significant portion of the current has flown and thus the ions moving across the membrane 204 are consumed while $H_2$ is formed, no pH change or ion accumulation will result if only $H^+$ is transported ($2H^+ + 2e^- \rightarrow H_2$). Only $Ti^{+3}$-formation will require one $H^+$ per $Ti^{+3}$ to cross the membrane 204, but, as shown above, parasitic consumption of the $Ti^{+3}$ during bath operation consumes $H^+$ per $Ti^{+3}$, which, if only $H^+$ ions are transported during regeneration, would be balanced. Similarly, $Ti^{+3}$ consumption by Sn deposition will require more Sn dissolution during Condition 3 in order to replenish the $Sn^{+2}$, which again will require the same amount of $H^+$ transported across the membrane 204 to balance the overall ion transport.

Embodiment 2

Cation Selective Membrane 204, $K_4P_2O_7/H_4P_2O_7$ at pH=Bath pH (=7) as the Anodic Liquid in the Counter Electrode Compartment 203

TABLE 5

Figure 5:
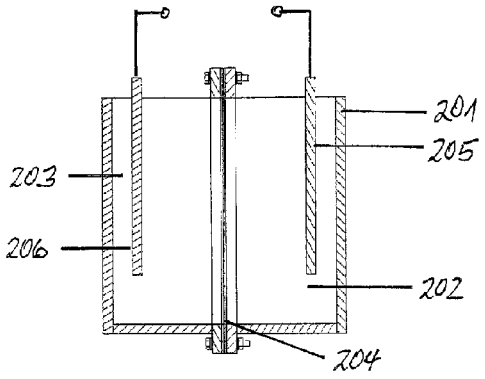
FIG. 5 shows schematic drawings of the plating device in a second plating embodiment (Case 2)
Figure 5:
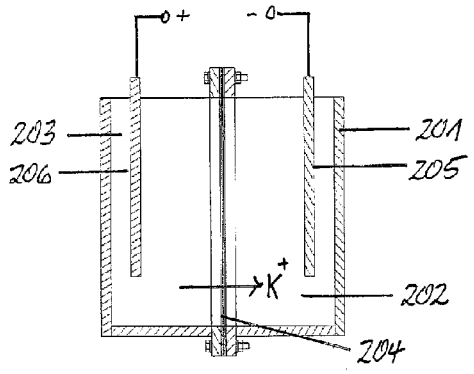
Figure 5:
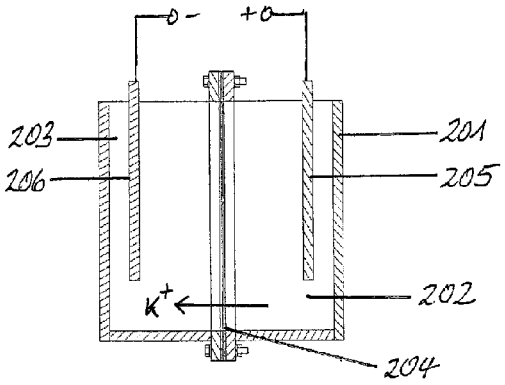

| Embodiment 2 - Cation selective membrane 204, $K_4P_2O_7/H_4P_2O_7$ at pH = bath pH (=7) as the anodic liquid in the counter electrode compartment 203; see FIG. 5. | |
|---|---|
| Condition 1: Open Circuit:<br>I = 0 A, V = Membrane potential<br>During idle time, the pH value stays constant, since the $K_4P_2O_7$ concentration in the counter electrode compartment 203 is chosen to be similar to that in the working electrode compartment 202. Since neither a $H^+$ nor a $K^+$ cation gradient exists, no diffusion is expected → constant pH<br>The initial pH of the $K_4P_2O_7$ solution is adjusted with $H_4P_2O_7$ solution. $H_3PO_4$ might work too. | To maintain pH, add nothing<br>Amount: 0<br>Accumulation of nothing |
| Condition 2: $Ti^{+3}$-regeneration:<br>Working electrode 205 cathodic, counter electrode 206 anodic, I ≈ 1.5 A<br>At pH = 7, approximately $10^{-7}$ mol/l $H^+$ ions are present in the bath, while a typical bath formulation contains 2.6 mol/l $K^+$ ions. It appears highly unlikely that the transport coefficient of $H^+$ through the membrane 204 is orders of magnitude higher than the one for $K^+$, therefore it is likely that mostly $K^+$ ions diffuse. This is supported by the observation that the pH in the counter electrode compartment 203 drops significantly during operation. | To maintain pH, add HCl<br>Amount: 1.0 mol per mol $Ti^{+4}$ converted to $Ti^{+3}$ and per mol $H_2$ being generated<br>Accumulation of both $K^+$ and $Cl^-$ since for each mol $K^+$ 1 mol $Cl^-$ has to be added to maintain a constant pH value |
| Condition 3: Sn Dissolution:<br>Working electrode 205 anodic, counter electrode 206 cathodic, I ≈ 1.5 A<br>As before, it is believed that nearly exclusively $K^+$ diffuses. Then no enrichment will result since the $K^+$. from $K_2CO_3$ dosed to maintain pH will be transported to the counter electrode compartment 203. | To maintain pH, add $K_2CO_3$<br>Amount: 1 mol per mol Sn being dissolved<br>Accumulation of nothing since all $K_2CO_3$ is consumed by $K^+$ diffusing to the counter electrode compartment 203 |

Despite the fact that operating the regeneration device 200 as laid out in this case is more convenient since the strong pH change during idle time does not occur, it was found that it ultimately will lead to more ion accumulation in the working electrode compartment 202. This is because of the $CL^-$ that has to be added to the working electrode compartment for compensating the pH shift caused by $K^+$ diffusion through the membrane 204 as the means of charge transport. E.g., $H_2$ evolution observed in Condition 2 will lead to $K^+$ (and, to maintain pH, $Cl^-$) accumulation in the working electrode compartment 202, while in Embodiment 1, the reaction $2H^+ + 2e^- \rightarrow H_2$ is pH neutral, since the necessary charge transport takes place by the diffusion of the 2 $H^+$ ions.

In addition, Embodiment 2 gave a different deposition behavior (higher rate, but more Sn fur/discoloration), presumably because of difficult control of $Cl^-$ concentration. It was shown in a separate beaker tests that $Cl^-$ concentration influences the plating rate and bath stability.

Judging from Embodiments 1 and 2, a combination might be best in which a pH value in the range of 2 to 4 and a suitable $K^+$ concentration as in the working electrode compartment 202 is maintained in the counter electrode compartment 203. Then the pH change during idle time will be slowed, while no HCl dosing similar to Embodiment 2 is necessary.

Embodiment 3

Cation Selective Membrane 204, Acidic K-Salt Solution as the Anodic Liquid in the Counter Electrode Compartment 203

TABLE 6

Figure 6:
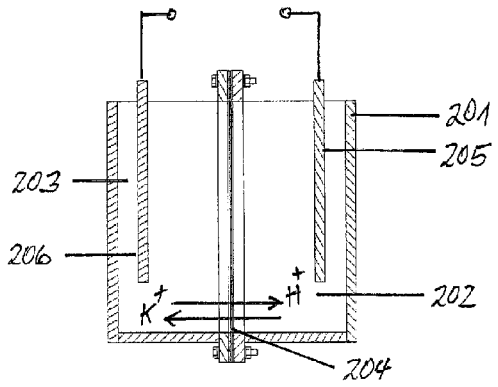
FIG. 6 shows schematic drawings of the plating device in a third plating embodiment (Case 3)
Figure 6:
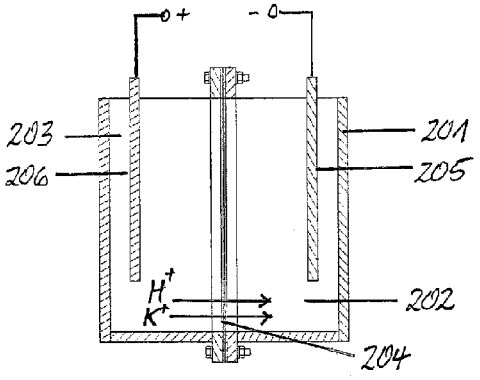
Figure 6:
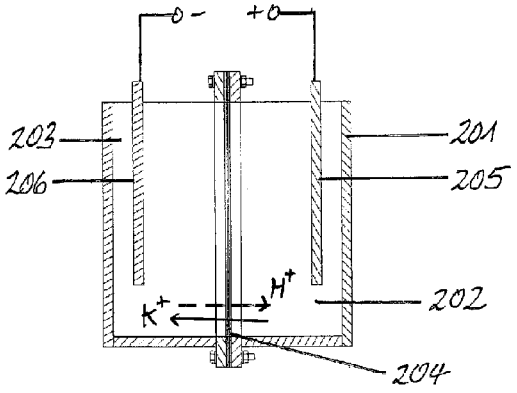

Embodiment 3 - Cation selective membrane 204, acidic K-salt solution as the anodic liquid in the counter electrode compartment 203; see FIG. 6.

| | |
|---|---|
| Condition 1: Open Circuit:<br>I = 0 A, V = Membrane potential<br>During idle time, pH drop is slower than when 7.5 wt.-% $H_2SO_4$ is used, but may still occur. Again, a membrane potential will result if the membrane 204 is more permeable for $H^+$ than for the other cations | To maintain pH, add $K_2CO_3$<br>Accumulation of eventually small amount of $K^+$ to compensate for $H^+$ diffusing to the working electrode compartment 202 |
| Condition 2: $Ti^{+3}$-reqencration:<br>Working electrode 205 cathodic, counter electrode 206 anodic, I ≈ 1.5 A<br>If the pH is chosen appropriately, $H^+$ and $K^+$ diffuse at the same rate resulting in a constant pH value. The appropriate choice of pH will depend on the ratio of $H_2$ to $Ti^{+3}$ formation and the respective $H^+/K^+$ cation permeability value of the membrane 204.<br>This operation mode will still result in a small increase of $K^+$ in the autocatalytic bath because of the $H_2$ formation. | To maintain pH, add $K_2CO_3$<br>Amount: 0.5 mol per mol $Ti^{+4}$ converted to $Ti^{+3}$<br>Accumulation of substantial amount (0.5 mol per mol $Ti^{+4}$) of $K^+$ to compensate for $H^+$ diffusing to the working electrode compartment 202 |
| Condition 3: Sn Dissolution:<br>Working electrode 205 anodic, counter electrode 206 cathodic, I ≈ 1.5 V<br>In this condition a substantial pH drop takes place which has to be compensated by $K^+$ addition. Since the charge transport is expected to be caused nearly exclusively by $K^+$, the overall ion enrichment will be small. | To maintain pH, add K2CO3<br>Amount: 1 mol per mol Sn being dissolved<br>Accumulation of close to nothing since all $K_2CO_3$ is consumed by $K^+$ diffusing to the counter electrode compartment 203 |

When comparing the three embodiments, it becomes clear that Embodiment 2 is the least preferred because of the strongest ion enrichment of the autocatalytic bath (ion enrichment of the counter electrode liquid is only a small concern because of its low cost and can potentially be remedied with an ion exchange resin). Embodiment 3 appears to be more difficult to control, while Embodiment 1 requires substantial dosing of $K_2CO_3$ (KOH dosing is less preferred because the strong pH increase at the location where KOH is added tends to cause precipitation), ion enrichment of the autocatalytic bath is the smallest.

Embodiment 4

Anion (Chloride Ion) Selective Membrane 204, Anodic Liquid in the Counter Electrode Compartment 203

As mentioned, an extra chamber is needed to prevent $Cl_2$ formation at the counter electrode when it is polarized anodically.

TABLE 7

Figure 7:
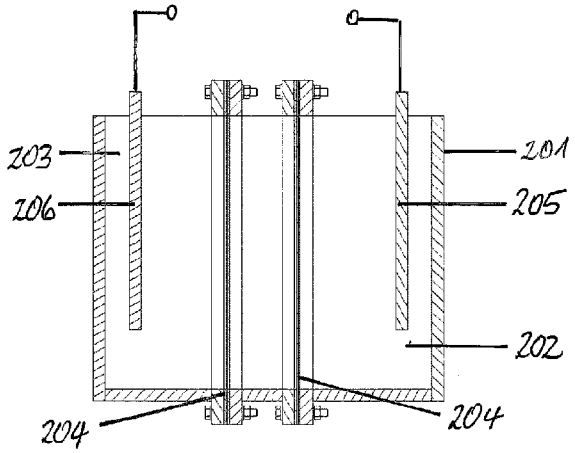
FIG. 7 shows schematic drawings of the plating device in a fourth plating embodiment (Case 4).
Figure 7:
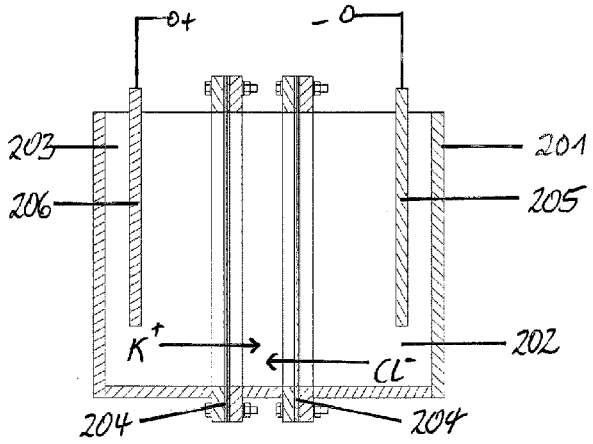
Figure 7:
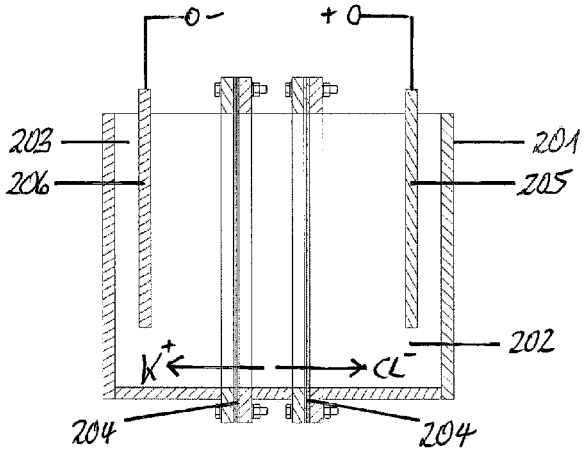

Embodiment 4 - Anion (chloride ion) selective membrane 204, anodic liquid in the counter electrode compartment 203; see FIG. 7.

| | |
|---|---|
| Condition 1: Open Circuit:<br>I = 0 A | To maintain pH, add nothing<br>Amount nothing |

TABLE 7-continued

| Embodiment 4 - Anion (chloride ion) selective membrane 204, anodic liquid in the counter electrode compartment 203; see FIG. 7. | |
|---|---|
| The $K_4P_2O_7$ concentration in the working electrode compartment 202, counter electrode compartment 203 and the additional center electrode compartment as well as the $Cl^-$ concentration in the working electrode compartment 202 and in the center electrode compartment are chosen to be similar. Since $Cl^-$ diffusion to the counter electrode compartment 203 is blocked by the cation selective membrane and no $H^+/K^+$ cation gradient exists, no diffusion and a constant pH will take place, accept if monovalent metal complexes diffuse from the working electrode compartment 202 to the center electrode compartment. | Accumulation of nothing, but diffusion of monovalent metal complexes (e.g., $(Ti(III)P_2O_7)^-$ or $(KSnP_2O_7)^-$) might lead to loss of Sn/Ti in the working electrode compartment 202 |
| Condition 2: $Ti^{+3}$-reqeneration: Working electrode 205 cathodic, counter electrode 206 anodic, I ≈ 1.5 A The plating composition typically contains 2.6 mol/l $K^+$ and 0.43 mol/l Cl- ions. At pH =/, approximately $10^{-/}$ mol/l $H^+$ ions are present in the composition, therefore it is presumed that mostly $K^+/Cl^-$ ions diffuse. A problem here is the selectivity of the membrane: Even if a highly monovalent anion selective membrane is used, it would allow the passage of monovalent metal complexes like $(Ti(III)P_2O_7)^-$. | To maintain pH, add HCl to the working electrode compartment 202 and KOH to the counter electrode compartment 203 Amount: 1 mol HCl/KOH per 1 mol $Ti^{+3}$ being generated Accumulation of nothing, but diffusion of monovalent metal complexes will lead to loss of Sn/Ti in the working electrode compartment 202 |
| Condition 3: Sn Dissolution Working electrode 205 anodic, counter electrode 206 cathodic, I ≈ 1.5 A Again, it is presumed that mostly $K^+$, $Cl^-$ diffuse, which now are less favorable since pH maintenance will now require addition of ions. But the system is likely to operate much longer in Condition 2. The pH can be allowed to increase in Condition 2 and then be reduced again in Condition 3, Conceivably, the pH value at the end of Condition 2 can be chosen so that no dosing is required in Condition 3. | To maintain pH, add $K_2CO_3$ to the working electrode compartment 202 and $H_3PO_4$ to the counter electrode compartment Amount: 1 mol $K_2CO_3$/0,66 mol $H_3PO_4$ per 1 mol Sn being dissolved Accumulation of $K^+$ in the working electrode compartment 202 and KOH in the counter electrode compartment 203 |

This arrangement is more complicated because of the larger number of compartments.

What is claimed is:

1. Regeneration apparatus (300) for regenerating a plating composition which is suitable for depositing at least one first metal on a substrate (10), said regeneration apparatus (300) being especially adapted to perform a method of regenerating a plating composition which is suitable for depositing at least one first metal on a substrate (10) and which is accommodated by at least one plating device (100), said plating composition containing said at least one first metal in an ionic form and at least one second metal in an ionic form, wherein said at least one second metal may be provided in a higher and in a lower oxidation state and, when it is provided in a lower oxidation state, is capable of reducing said at least one first metal being in the ionic form to a metallic state, wherein said plating composition is accommodated by at least one plating device (100) and contains at least one first metal in an ionic form and at least one second metal in an ionic form, wherein said at least one second metal may be provided in a higher and in a lower oxidation state and, when it is provided in a lower oxidation state, is capable of reducing said at least one first metal being in the ionic form to a metallic state, said regeneration apparatus (300) comprising:

(a) at least one regeneration device (200) comprising:

i. a working electrode compartment (202) and a counter electrode compartment (203);

ii. a working electrode (205) being disposed in said working electrode compartment (202) and a counter electrode (206) being disposed in said counter electrode compartment (203);

iii. an ion selective membrane (204) separating said working electrode compartment (202) and said counter electrode compartment (203) from each other;

iv. an electric current supply for energizing said working electrode (205) and said counter electrode (206);

(b) means (250, 260, 257, 267) for removing at least part of said plating composition from said at least one plating device (100) and means (280, 285, 286) for contacting said removed plating composition with said working electrode (205);

(c) at least one first holding tank (230) being adapted for accommodating a first portion of said removed composition after said first portion of said removed composition has been cathodically treated in said regeneration device (200);

(d) at least one second holding tank (240) being adapted for accommodating a second portion of said removed composition after said second portion of said removed composition has been anodically treated in said regeneration device (200); and (e) means (250, 260, 235, 245) for returning said first and second portions to said at least one plating device (100), wherein said at least one first holding tank (230) and said at least one second holding tank (240) are in fluid connection with said at least one regeneration device (200).

2. The apparatus (300) according to claim 1, wherein said at least one working electrode (205) is made from said at least one first metal in the metallic state.

3. The apparatus (300) according to claim 2, wherein said at least one working electrode (205) is made of pieces of said at least one first metal in the metallic state and wherein said pieces of said at least one first metal in the metallic state are contained in a container (207) which is made from an inert material.

4. The apparatus according to claim 2, wherein said ion selective membrane (204) is a cation selective membrane.

5. The apparatus (300) according to claim 1, wherein said at least one working electrode (205) is made of pieces of said at least one first metal in the metallic state and wherein said pieces of said at least one first metal in the metallic state are contained in a container (207) which is made from an inert material.

6. The apparatus according to claim 5, wherein said at least one first metal is tin.

7. The apparatus according to claim 6, wherein said ion selective membrane (204) is a cation selective membrane.

8. The apparatus according to claim 5, wherein said ion selective membrane (204) is a cation selective membrane.

9. The apparatus according to claim 3, wherein said at least one first metal is tin.

10. The apparatus according to claim 3, wherein said ion selective membrane (204) is a cation selective membrane.

11. The apparatus according to claim 1, wherein said ion selective membrane (204) is a cation selective membrane.

12. A Regeneration apparatus (300) for regenerating a plating composition which is suitable for depositing at least one first metal on a substrate (10), said regeneration apparatus (300) being especially adapted for regenerating a plating composition which is suitable for depositing at least one first metal on a substrate (10) and which is accommodated by at least one plating device (100), said plating composition containing said at least one first metal in an ionic form and at least one second metal in an ionic form, wherein said at least one second metal may be provided in a higher and in a lower oxidation state and, when it is provided in a lower oxidation state, is capable of reducing said at least one first metal being in the ionic form to a metallic state, wherein said plating composition is accommodated by at least one plating device (100) and contains at least one first metal in an ionic form and at least one second metal in an ionic form, wherein said at least one second metal may be provided in a higher and in a lower oxidation state and, when it is provided in a lower oxidation state, is capable of reducing said at least one first metal being in the ionic form to a metallic state, said regeneration apparatus (300) comprising:

(a) at least one regeneration device (200) comprising:
  i. a working electrode compartment (202) and a counter electrode compartment (203);
  ii. a working electrode (205) being disposed in said working electrode compartment (202) and a counter electrode (206) being disposed in said counter electrode compartment (203);
  iii. an ion selective membrane (204) separating said working electrode compartment (202) and said counter electrode compartment (203) from each other;
  iv. an electric current supply for energizing said working electrode (205) and said counter electrode (206);

(b) means (250, 260, 257, 267) for removing at least part of said plating composition from said at least one plating device (100) and means (280, 285, 286) for contacting said removed plating composition with said working electrode (205);

(c) at least one first holding tank (230) being adapted for accommodating a first portion of said removed composition after said first portion of said removed composition has been cathodically treated in said regeneration device (200);

(d) at least one second holding tank (240) being adapted for accommodating a second portion of said removed composition after said second portion of said removed composition has been anodically treated in said regeneration device (200); and (e) means (250, 260, 235, 245) for returning said first and second portions to said at least one plating device (100),
  wherein said at least one first holding tank (230) and said at least one second holding tank (240) are in fluid connection with said at least one regeneration device (200);

(f) wherein said at least one working electrode (205) is made from said at least one first metal in the metallic state;

(g) wherein said at least one working electrode (205) is made of pieces of said at least one first metal in the metallic state and wherein said pieces of said at least one first metal in the metallic state are contained in a container (207) which is made from an inert material;

(h) wherein said at least one first metal is tin; and (i) wherein said ion selective membrane (204) is a cation selective membrane.

* * * * *